United States Patent [19]

Ohtani et al.

[11] Patent Number: 4,897,340

[45] Date of Patent: Jan. 30, 1990

[54] SILVER HALIDE PHOTOGRAPHIC MATERIAL CONTAINING A SPECIFIED WATER CONTENT, AND METHOD OF PROCESSING THE SAME

[75] Inventors: Shinichi Ohtani; Teruo Kashino; Katsushi Fujita; Akio Suzuki; Eiji Yoshida; Satoru Nagasaki, all of Hino, Japan

[73] Assignee: Konica Corporation, Japan

[21] Appl. No.: 279,452

[22] Filed: Dec. 5, 1988

Related U.S. Application Data

[63] Continuation of Ser. No. 25,196, Mar. 12, 1987, abandoned.

[30] Foreign Application Priority Data

Mar. 13, 1986 [JP] Japan ..... 61-53651

[51] Int. Cl.[4] ..... G03C 5/00; G03C 5/36; G03C 1/30; G03C 1/34

[52] U.S. Cl. ..... 430/403; 430/446; 430/564; 430/621; 430/963; 430/966

[58] Field of Search ..... 430/403, 432, 564, 621, 430/966, 642, 532, 445, 963, 446

[56] References Cited

U.S. PATENT DOCUMENTS

| | | | |
|---|---|---|---|
| 4,040,898 | 8/1977 | Yamaguchi | 430/936 |
| 4,435,500 | 3/1984 | Okutsu et al. | 430/419 |
| 4,678,741 | 7/1987 | Yamada et al. | 430/567 |

FOREIGN PATENT DOCUMENTS

| | | |
|---|---|---|
| A2114309 | 8/1983 | United Kingdom . |
| A2135071 | 8/1984 | United Kingdom . |

OTHER PUBLICATIONS

European Search Report.

*Primary Examiner*—Paul R. Michl
*Assistant Examiner*—Patrick A. Doody
*Attorney, Agent, or Firm*—Finnegan, Henderson, Farabow, Garrett & Dunner

[57] ABSTRACT

A silver halide photographic material is disclosed which has at least one hydrophilic colloidal layer on a support, said photographic material having a water content of 10–20 g/m$^2$ at the time when the washing step of processing with a roller transport type automatic processor is completed.

15 Claims, 1 Drawing Sheet

SILVER HALIDE PHOTOGRAPHIC MATERIAL CONTAINING A SPECIFIED WATER CONTENT, AND METHOD OF PROCESSING THE SAME

This application is a continuation, of application Ser. No. 07/025,196, filed Mar. 12, 1987, now abandoned.

BACKGROUND OF THE INVENTION

1. Field of the Invention

The present invention relates to a silver halide photographic material and a method of processing it. The present invention is applicable to the production of rapidly processable light-sensitive materials and to their rapid processing. Therefore, the present invention finds utility in X-ray film applications.

2. Description of the Prior Art

The consumption of silver halide photographic materials has been increasing in the past decade and, in order to meet the increased demand of consumers for developing and processing photographic films, more rapid development and processing, or an increased capability of process film within a given period of time, is greatly needed. This tendency is also found in areas where X-ray light-sensitive materials such as medical X-ray films are used. As it is recommended that periodical checkups should be strictly carried out, the number of medical tests currently being conducted is growing rapidly. On the other hand, more items are included these days in clinical testing in order to ensure more accurate diagnoses. Both of these factors have lead to an increase in the number of X-ray images to be taken. In addition, persons who have received check-ups want to know the results as soon as possible. In order to meet these demands in the medical field, not only is it necessary to automate diagnostic procedures (e.g. imaging and film transport) but it is also required to process X-ray films more rapidly.

A common method of reducing the length of the processing time (consisting of development, fixing, washing and drying steps) is to increase the film transport speed. However, if the roller speed is increased in an attempt at reducing the processing time required for processing with a roller transport type automatic processor, several problems occur, such as (a) insufficient densities (ie, decreased sensitivity, contast and maximum density), (b) insufficient fixing, (c) insufficient film washing with water, and (d) insufficient film drying. If fixing and washing are insufficient, the color of the processed film will change during its storage to cause image deterioration.

These problems could be solved by reducing the gelatin content but a film having a lower gelatin content has a tendency to produce a grainy photographic image. In addition, if films are rubbed against each other or against another object, the rubbed portion will produce a higher density than other areas if the film is developed and this phenomenon is generally referred to as "abrasion blackening".

It is therefore required to realize very rapid processing of photographic films without causing any of the problems associated with increased roller speeds or decreased gelatin contents. The term "very rapid processing" as used in this specification means that the total period of time required for the film to be transported from the point where its front end is inserted into an automatic processor and passes through a developer tank, a transit area, a fixing tank, the next transit area, a washing tank, a further transit area, and a drying section to the point where it finally emerges from the last-mentioned section is within the range of from 20 to 60 seconds. The total processing time (sec) may be obtained by dividing the total length (m) of processing line by the line transport speed (m/sec). The time required for the film to pass through the three transit areas is included in the total processing time because, as is well known in the art, substantial processing is regarded to take place in each of these transit areas where the gelatin film is also wetted with the processing solution carried over from the previous step.

Japanese Patent Publication No. 47045/1976 mentions the importance of gelatin content for the purpose of rapid processing but the total processing time including passage through transit areas that is attained by this technique ranges from 60 to 120 seconds, which is longer than is desirable in a truly "very rapid" processing.

Another requirement that should be met by modern photographic materials is high sensitivity. For instance, in the wake of the rapid increasing frequency of medical X-ray testing conducted these days, not only those in the medical field but also public opinion at large sees a strong need to reduce the total dose of X-rays to which a patient is exposed and thus the development of highly sensitive photographic materials which requires lower X-ray doses to produce images that have sharpness even in fine detail is desired.

Many and various techniques are available for achieving sensitization, or providing an increased sensitivity for a given grain size. If an appropriate sensitization technique is employed, it will be possible to achieve a higher sensitivity with the grain size (hence the covering power) being maintained at the same level. Among the sensitization techniques reported so far are included: addition of a development accelerator such as a thioether to the emulsion; supersensitizing a spectrally sensitized silver halide emulsion with an appropriate combination of dyes; and employing improved optical sensitizers. However, these methods do not always provide the intended results when they are applied to high-sensitivity silver halide photographic materials; that is, if silver halide emulsions intended to be used in high-sensitivity silver halide photographic materials are treated by these methods, the materials are liable to experience fogging during storage.

In the field of medical X-ray photography, conventionally used light-sensitive materials of the regular type having a spectral sensitivity up to 450 nm are being replaced by ortho-type materials which have been subjected to orthochromatic sensitization so that they possess sensitivity up to a wavelength of 540–550 nm. These sensitized materials not only have an extended spectral sensitivity region but also display increased sensitivity and hence are effective for the purpose of minimizing potential hazards to human health by reducing the total dose of X-rays. Although dye sensitization is a very useful means of sensitization, many problems still remain unsolved; for instance, the sensitivity that can be attained is highly dependent on the type of specific photographic emulsion used.

It is well known to incorporate indazoles or benzotriazoles in a developing solution as anti-foggants. These compounds have been used as anti-foggants both in black-and-white developers and in color developers. While the use of these compounds as anti-foggants is shown in many patent specifications, three are listed here: U.S. Pat. No. 2,271,229 which describes the use of an indazole-based anti-foggant in both a black-and-white developer and in a color developer; BP No. 1,437,053 which discloses the use of an indazole in an X-ray developer as an anti-foggant; and U.S. Pat. No. 4,172,728 which shows the use of an indazole in a graphic arts developer as an antifoggant. These indazole and benzotriazole compounds are very effective anti-foggants, but they still have the disadvantage of causing a substantial drop in sensitivity.

SUMMARY OF THE INVENTION

An object, therefore, of the present invention is to provide a silver halide photographic material that can be processed at high speed, even at a very high speed which is rapid enough to reduce the total processing time to be within the range of 20–60 seconds, without experiencing any of the aforementioned problems of the prior art, and which affords high sensitivity and superior fogging and graininess characteristics, with the attendant advantage that the gelatin content of the photographic material can be reduced without causing "abrasion blackening" or desensitization when subjected to pressure.

Another object of the present invention is to provide a method that is suitable for processing said photographic material.

DETAILED DESCRIPTION OF THE INVENTION

Figure 1:
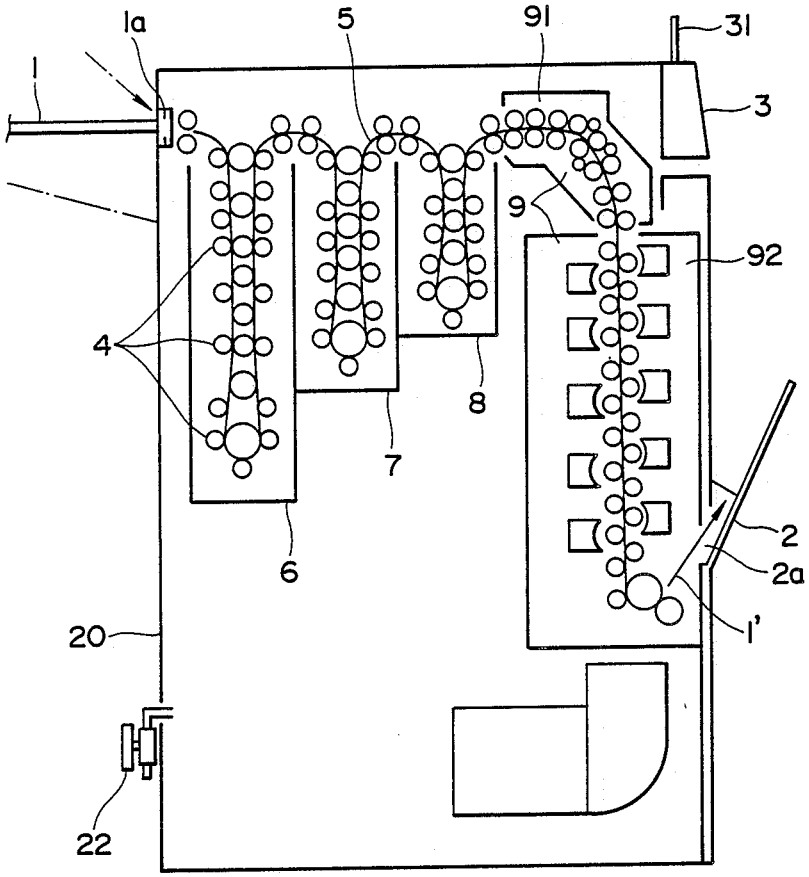
FIG. 1 is a schematic drawing showing an automatic developing machine that can be used in the practice of the present invention.

The first object of the present invention can be attained by a silver halide photographic material that has at least one hydrophilic colloidal layer on a support and which is designed to have a water content of 10–20 $g/m^2$ at the time when the washing step of processing with a roller transport type automatic processor is completed.

While the water content of the silver halide photographic material of the present invention can be adjusted to lie within the above-specified range by a variety of techniques, a typical method consists of adjusting the melting time of said photographic material to be within the range of 8–45 minutes while controlling the gelatin content of hydrophilic colloidal layers including light-sensitive silver halide emulsion layers to lie within the range of 2.00–3.50 $g/m^2$.

The water content, as defined above, of the photographic material of the present invention is preferably within the range of 11–18 $g/m^2$, more preferably from 12 to 16 $g/m^2$.

While the photographic material preferably has a melting time of 8–45 minutes, the range of 12–40 minutes is more preferable and the range of 15–30 minutes is most preferable.

The desired melting time may be attained by adjustment with a suitable hardening agent. To this end, any known hardening agents may be employed either singly or in admixture. Usable hardening agents are exemplified below: chromium salts such as chrome alum and chromium acetate; aldehydes such as formaldehyde, glyoxal and glutaraldehyde; N-methylol compounds such as dimethylolurea and methylol dimethylhydantoin; dioxane derivatives such as 2,3-dihydroxydioxane; activated vinyl compounds such as 1,3,5-triacryloylhexahydro-2-triazine and 1,3-vinylsulfonyl-2-propanol; activated halide compounds such as 2,4-dichloro-6-hydroxy-3-triazine; and mucohalogenic acids such as mucochloric acid and mucophenoxychloric acid.

Preferably used hardening agents are aldehyde compounds such as formaldehyde and glyoxal, S-triazine compounds such as 2-hydroxy-4,6-dichlorotriazine sodium salt, and vinyl sulfonic acid compounds.

The amount of hardening agent used will vary if it is used together with a hardening accelerator or a hardening inhibitor. A preferable range is from $1\times10^{-6}$ to $1\times10^{-2}$ mole per gram of gelatin, with the range of $5\times10^{-5}$ to $5\times10^{-3}$ moles per gram of gelatin being more preferable.

Typical examples of the hardening agent that can be used in the present invention are listed below but it should be understood that the scope of the present invention is by no means limited by these specific examples.

Typical hardening agents:

HCHO (1)

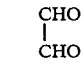
(2)

$CH_3CHO$ (3)

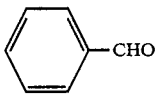
(4)

$OHC\leftarrow CH_2\rightarrow_3 CHO$ (5)

$ClCH_2CONHCOCH_2Cl$ (6)

$ClCH_2COOCH_2CH_2OOCCH_2Cl$ (7)

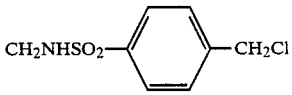
(8)

$CH_3COCl$ (9)

$CH_3COCH_2C$ (10)

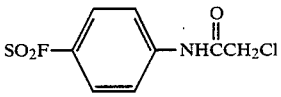
(11)

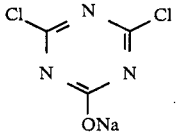
(12)

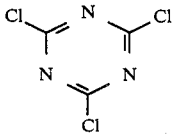
(13)

-continued

Typical hardening agents:

(14)

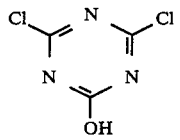

(15)

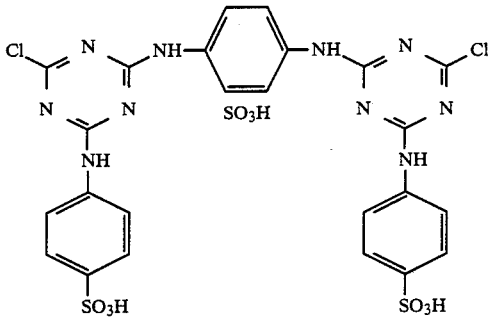

(16) $CH_2{=}CHSO_3(CH_2)_3SO_2CH{=}CH_2$ (17)

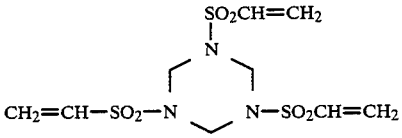

(18) $C(CH_2SO_2CH{=}CH_2)_4$ (19)

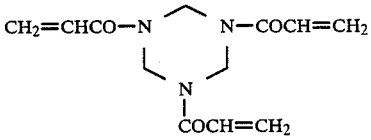

(20) $CH_2{=}CHCOOCOCH{=}CH_2$

(21) $CH_2{=}CH{-}O{-}CH{=}CH_2$ (22)

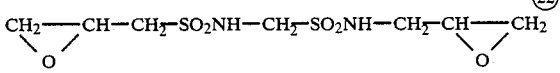

(23)

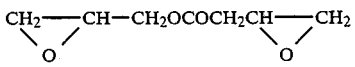

(24)

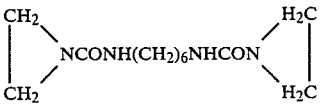

(25)

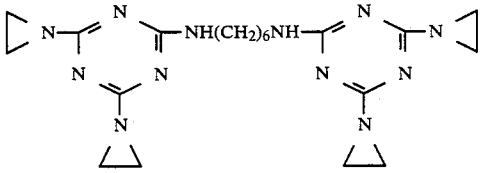

(26)

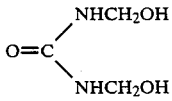

-continued

Typical hardening agents:

(27)

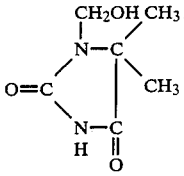

(28)

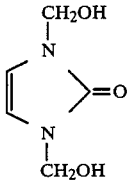

(29)

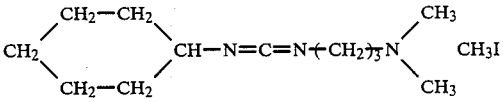

(30)

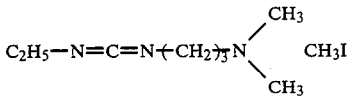

(31)

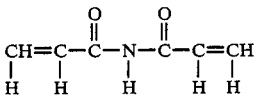

The second object of the present invention is achieved by a method of processing a silver halide photographic material having at least one hydrophilic colloidal layer on a support, said method being so designed that the water content of the photographic material will lie in the range of 10–20 g/m$^2$ at the time when a washing step of processing with a roller transport type automatic processor is completed.

In a preferred embodiment, the photographic material of the present invention is processed with a developing solution that contains a compound of the following general formula (IA) and/or a compound of the following general formula (IIA):

(IA)

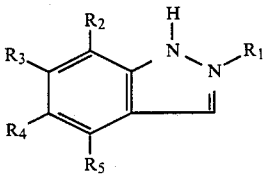

(IIA)

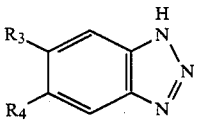

where $R_1$, $R_2$, $R_3$, $R_4$ and $R_5$ each signifies a hydrogen atom, a lower alkyl group, an alkoxy group, a carboxy group, an alkoxycarbonyl group, a sulfo group, a halogen atom, an amino group or a nitro group, each of these groups optionally having one or more substituents.

Typical examples of the compound of formula (IA) are listed below but it should be understood that the scope of the present invention is by no means limited by these examples.

Illustrative compounds of (IA):

I-1: 5-nitroindazole
I-2: 5-aminoindazole
I-3: 5-p-toluensulfonamid-indazole
I-4: 5-chloroindazole
I-5: 5-benzoylacetamino-indazole
I-6: 5-cyanoindazole
I-7: 5-p-nitrobenzoylamino-indazole
I-8: 1-methyl-5-nitro-indazole
I-9: 6-nitroindazole
I-10: 3-methyl-5-nitro-indazole, and
I-11: 4-chloro-5-nitro-indazole.

Among these compounds of formula (IA), nitroindazoles are preferable for use in the developing solution employed in the present invention, and 5-nitroindazole having the following structural formula is particularly preferable:

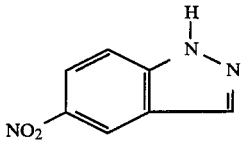

Typical examples of the compound of formula (IIA) are listed below but it should be understood that the scope of the present invention is by no means limited by these examples.

Illustrative compounds of (IIA):

(II-1)

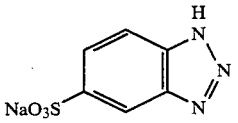

(II-2)

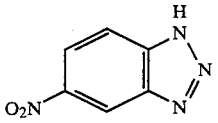

(II-3)

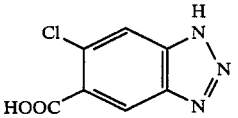

(II-4)

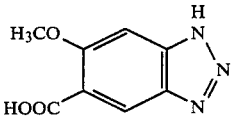

(II-5)

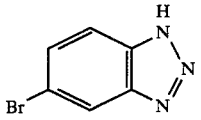

(II-6)

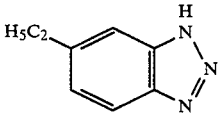

-continued

Illustrative compounds of (IIA):

(II-7)

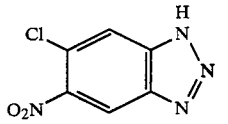

(II-8)

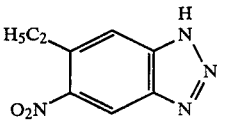

(II-9)

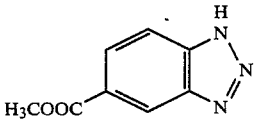

(II-10)

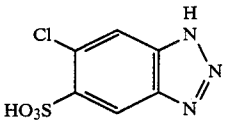

(II-11)

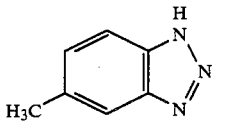

The method of the present invention is adapted to very rapid processing of silver halide photographic materials, and is preferably embodied in processing with an automatic processor that is completed within a total period of 20–60 seconds.

In one preferred embodiment of the present invention, the hydrophilic colloidal layers on the side of a support which has light-sensitive silver halide emulsion layers has a gelatin content of 2.00–3.50 g/m$^2$, preferably 2.40–3.30 g/m$^2$, more preferably 2.50–3.15 g/m$^2$, inclusive of the gelatin in the silver halide emulsion layers. If the gelatin content is within this range, fewer coating troubles will occur than when the gelatin content is less than 2.00$^2$, and better drying properties are attained than when the gelatin content is larger than 3.10 g/m$^2$. More preferably, the gelatin content is within the range of 2.40–2.90 g/m$^2$, with the range of 2.50–2.80 g/m$^2$ being most preferable. In accordance with the preferred embodiment described above, characteristics such as sensitivity and resistance to yellow staining can be further improved.

In another preferred embodiment of the present invention, the silver halide grains used in a silver halide emulsion layer have an average size of 0.30–1.20 μm, more preferably 0.40–1.00 μm, with the range of 0.40–0.80 μm being most preferred.

The size of silver halide grains is expressed by the length of one side of an equivalent cube that has the same volume as that of an individual grain, and the average grain size is the arithmetic mean of the sizes of the grains of interest.

In the present invention, silver halide emulsion layers are coated in a wet thickness which preferably ranges from 35 to 85 μm, more preferably from 40 to 75 μm, with the range of 45–70 μm being most preferable. If the wet thickness is excessive, the drying load is increased and it sometimes becomes necessary to make certain provisions to cope with an increase in the quantity of heat required for drying or the decrease in coating speed, which eventually leads to a higher cost and a lower production rate. If the wet thickness is unduly small, it may become difficult to achieve uniform and trouble-free coating.

If two or more coating solutions are applied simultaneously onto a support, the wet thickness as defined in this specification means the total thickness (μm) of the coated layers in a wet state that form immediately after the application of those coating solutions (i.e., before the coating begins to dry). If only one layer is applied at a time, the wet thickness corresponds to that of a single layer in a wet state that forms immediately after the application of that layer. The wet thickness (μm) as defined above may be determined by the following equation:

$$\text{Wet thickness } (\mu m) = [\text{total supply of coating solutions } (L/\text{min}) \times 1{,}000]/[\text{coating speed } (m/\text{min}) \times \text{coating width } (m)].$$

If coating is performed in more than one stage (ie, each subsequent coating is done after the previous coating has dried), the wet thickness as defined hereinabove means the thickness of the coating solution applied in each stage.

Still another preferred embodiment of the present invention relates to the case where two or more hydrophilic colloidal layers are present on the side of a support which has light-sensitive silver halide emulsion layers; in this embodiment, the coating solution that will form the topmost layer is preferably applied in such a manner that it has a surface tension at least 6 dynes/cm smaller than that of the coating solution which will form a layer that is adjacent said topmost layer. The difference in surface tension between the two coating solutions is more preferably at least 8 dynes/cm, with 10 dynes/cm or larger being most preferred.

In order to attain the necessary difference in surface tension, at least one surfactant may be incorporated in the coating solution which is used to form the topmost hydrophilic colloidal layer. The coating solution for forming a layer adjacent this topmost layer may or may not contain a surfactant, and if a surfactant is used, it may be the same as or different from the one that is incorporated in the coating solution used to form the topmost layer.

Useful surfactants include: nonionic surfactants such as saponin (steroid), alkylene oxide derivatives, glycidol derivatives, aliphatic acid esters of polyhydric alcohols, and alkyl esters of sugars; anionic surfactants containing acidic groups such as carboxy, sulfo, phospho, sulfate ester, and phosphate ester groups; amphoteric surfactants such as amino acids, aminoalkylsulfonic acids, aminoalkylsulfuric or phosphoric acid esters, alkylbetaines, and amine oxides; cationic surfactants such as alkylamine salts, aliphatic or aromatic quaternary ammonium salts, heterocyclic quaternary ammonium salts such as pyridinium and imidazolium, and aliphatic or heterocyclic phosphonium or sulfonium salts; as well as fluorine-containing surfactants which may optionally contain a polyoxyethylene group.

The silver halide grains used in light-sensitive silver halide emulsion layers in the photographic material of the present invention may have any desired grain size distribution. These silver halide grains may be monodispersed in that 95% of the grains are within 60%, preferably 40%, of the number average grain size.

The silver halide grains present in light-sensitive silver halide emulsion layers are preferably such that at least 80% by weight or number of the silver halide grains concerned have a regular structure or shape. Silver halide grains having a regular structure or shape are those which grow isotropically without producing any anisotropically growing surfaces such as twinned faces; such silver halide grains have cubic, tetradecahedral, octahedral, dodecahedral or other regular crystallographic forms. Processes for preparing such regular silver halide grains may be found in, for example, J. Phot. Sci., 5, 332 (1961), Ber. Bunsenges. Phys. Chem., 67, 949 (1963), and Intern. Congress Phot. Sic., Tokyo, 1967.

In the practice of the present invention, two or more separately prepared silver halide emulsions may be used in admixture.

The silver halide grains or silver halide emulsions used in the present invention preferably contain at least one soluble salt selected from among the salts of iridium, thallium, palladium, rhodium, zinc, cobalt, uranium, thorium, strontium, tungsten, and platinum. The content of these soluble salts is preferably within the range of $10^{-6}$ to $10^{-1}$ mole per mole of silver halide. It is particularly preferable that at least one of the salts of thallium, palladium and iridium is contained in the silver halide grains or emulsions. These salts may be used either singly or in admixture and they may be added at any state of preparation. By using these soluble salts, improvement will be achieved in terms of various characteristics such as flash exposure characteristics, resistance to desensitization under pressure, resistance to fading of latent images under exposure to light, and sensitization.

In the practice of the present invention, silver halide emulsions may be composed of any silver halide that is employed in ordinary silver halide emulsions, such as silver bromide, silver iodobromide, silver iodochloride, silver chlorobromide, and silver chloride. The light-sensitive silver halide emulsion layer contains silver iodide in an amount of at least 10 mole %.

The silver halide grains in the silver halide emulsions used in the present invention may be prepared by any known method such as the acid process, neutral process and ammoniacal process. The grains may be allowed to grow in one step, or they may be obtained by growth of seed grains. The method of preparing seed grains may be the same as or different from the one used to achieve their growth.

In preparing a silver halide emulsion, halide ions and silver ions may be mixed by simultaneous addition, or either halide or silver ions may be added to a solution containing the other ions. Alternatively, halide ions and silver ions may be added simultaneously into a reactor in stages, with the pH and pAg being controlled in consideration of the critical growth rate of silver halide crystals. By employing this method, silver halide grains that have a regular crystallographic shape and a substantially uniform grain size can be obtained. After their growth, the silver halide grains may be converted to have a desired halide composition.

It is particularly preferable that the pAg of the silver halide grains being prepared is adjusted to 9.7 or higher in the latter stage of their preparation; that is, when at least half the amount of silver to be prepared has formed or precipitated, the pAg is allowed to change momentarily or gradually such that it will be at least 9.7 at the time the preparation is completed. It is more preferable that when the amount of silver that has formed or precipitated is within the range of from two thirds to nine tenths of the amount to be prepared, the pAg is allowed to change gradually such that it will be at least 9.7 at the time when the preparation is completed.

The silver halide grains used in the present invention may constitute any proportion of the emulsion layer in which they are present; preferably, they are present in an amount of at least 40% of the silver in the total silver halide grains, with the value of at least 90% being particularly preferable.

The silver halide emulsion used in the present invention may optionally be prepared in the presence of a silver halide solvent that is effective in controlling the size, shape, size distribution and growth rate of the silver halide grains being formed.

Suitable silver halide solvents include ammonia, thioether, thiourea, thiourea derivatives such as four-substituted thiourea and imidazole derivatives For thioether, reference may be had to U.S. Pat. Nos. 3,271,157, 3,790,387 and 3,574,628. Silver halide solvents other than ammonia are preferably used in amounts ranging from $10^{-3}$ to 1.0 wt %, more preferably from $10^{-2}$ to $10^{-1}$ wt %, of the reaction solution. The ammonia used as a silver halide solvent may have any concentration.

During the formation and/or growth of the silver halide grains for use in the silver halide emulsion used in the present invention, metal ions may be added in the form of at least one salt selected from among a cadmium salt, a zinc salt, a thallium salt, an iridium salt (or a complex salt containing the same), a rhodium salt (or a complex salt containing the same), and an iron salt (or a complex salt containing the same), so that one or more of these metal elements are incorporated in the interior of the grains and/or deposited on their surfaces. Alternatively, reduction sensitized nuclei may be imparted to the interior and/or onto the surfaces of grains by placing them in an appropriate reducing atmosphere.

After completion of the growth of silver halide grains, the silver halide emulsion used in the present invention may be freed of any unwanted soluble salts; if desired, such soluble salts may be left unremoved from the emulsion. Removal of unwanted salts may be achieved by employing the method described in Research Disclosure No. 17643.

The silver halide grains in the silver halide emulsion used in the present invention may have a uniform distribution of silver halide composition throughout the interior of the grain; alternatively, they may be of the core/shell type with different silver halide compositions on the interior and the surface of their grains.

If the silver halide grains used in the present invention have internal nuclei that are formed of silver iodobromide, they preferably have a homogeneous solid solution phase. The term "homogeneous" may be specified as follows in accordance with the definition set forth in Japanese Patent Application (OPI) No. 110926/1981 (the symbol OPI as used hereinafter shall mean an unexamined published Japanese patent application): when a powder of silver halide grains is subjected to X-ray diffractiometry with Cu-K$\beta$ X rays, the peak of the Miller indices [200] for a plane of silver iodobromide crystal has a half-value width ($\Delta 2\theta$) of no greater than 0.30 degrees. The operating conditions of the diffractometer employed may be expressed as $\omega r/\gamma \leqq 10$, where $\omega$ is the scanning speed (deg/min) of a goniometer, r is the time constant (sec), and Y is the width (mm) of a receiving slit.

The iodine content of the internal nuclei and coating layers of silver halide grains may be determined by, for example, the method described in J. I. Goldstein and D. B. Williams, "X-ray analysis in TEM/ATEM", Scanning Electron Microscopy, 1, 651, published by IIT Research Institute, Mar. 1977.

A silver halide emulsion that may be used in the practice of the present invention may contain silver halide grains each consisting of an internal nucleus formed of silver bromide or silver iodobromide, a first coating layer of silver iodobromide that is formed around the nucleus, and a second coating layer of silver bromide or silver iodobromide that is formed around the first coating layer, the iodine content of said first coating layer being at least 10 mol % larger than that of the internal nucleus, and the silver in the first coating layer assuming 0.01–30 mol % of the total silver. In this case, the silver halide grains may be negative-working, with the surface sensitivity being equal to or higher than the internal sensitivity, preferably at least twice the latter. The silver halide grains may be such that the ratio of the size of their projected area to thickness is less than 5. The size of projected area means the diameter of an equivalent circle having the same area as the projected area of a given grain, and the thickness means the length of the shortest path through the center of gravity of that grain.

If the silver halide grains used in the present invention consist of the internal nucleus, the first coating layer and the second coating layer defined above, these components preferably have the following characteristics: the internal nucleus preferably has an average iodine content of no more than 10 mol %, preferably 0–5 mol %, with the range of 0–3 mol % being particularly preferable; the silver in the internal nucleus preferably assumes at least 1.0 mol % of the total silver; the first coating layer has a silver iodide content which is at least 10 mol % higher than that of the internal nucleus, with the difference being preferably at least 20 mol % and more preferably at least 25 mol %; the silver in the first coating layer preferably assumes 0.1–25 mol %, more preferably 1.0–15 mol %, and most preferably 3.0–10.0 mol %, of the total silver.

If the internal nucleus and/or the first coating layer and/or the second coating layer is formed of silver iodobromide, they need not necessarily be homogeneous in composition but homogeneity of the silver iodobromide is preferable. The term "homogeneity" as used hereinabove may be specified as follows: when a powder of silver halide grains is subjected to X-ray diffractiometry with Cu-K$\beta$ X rays, the peak of the Miller indices [200] for a plane of silver iodobromide crystal has a half-value width ($\Delta 2\theta$) of no greater than 0.30 degrees. The operating conditions of the diffractometer meter used may be expressed as $\omega r/\gamma \leqq 10$, where $\omega$ is the scanning speed (deg/min) of a goniometer, r is the time constant (sec), and $\gamma$(mm) is the width of a receiving slit.

In order to provide sufficient coverage of the first coating layer, the second coating layer preferably has an average thickness of at least 0.02 $\mu$m, more preferably has a silver iodine content of 0–10 mol %.

The silver halide grains described above may constitute any proportion of the emulsion layer in which they are present; preferably, they are present in an amount of at 40% of the silver in the total silver halide grains, with a value of at least 90% being particularly preferable.

The internal nuclei of the silver halide grains described above may be prepared by various methods such as those described in P. Glafkides, Chimie et Physique Photographique, Paul Montel, 1967; G. F. Duffin, Photographic Emulsion Chemistry, The Focal Press, 1966; and V. L. Zelikman and S. M. Levi, Making and Coating Photographic Emulsions, the Focal Press, 1964. The acid process, the neutral process or the ammoniacal process may be employed as required. Soluble silver salts may be reacted with soluble halide salts by various methods such as the single-jet method, the double-jet method, and combinations thereof. The "reverse mixing method" wherein grains are formed in the presence of excess silver ions may also be employed. One version of the double-jet method is the controlled double-jet method wherein a silver halide is formed with the pAg of a liquid phase medium held constant. By employing this method, a silver halide emulsion comprising grains having a regular crystallographic shape and a uniform grain size can be attained.

Two or more separately prepared silver halide emulsions may be used in admixture.

The formation or physical ripening of the internal nuclei of silver halide grains may be effected in the presence of a cadmium salt, a zinc salt, a lead salt, a thallium salt, an iridium salt or a complex salt thereof, a rhodium salt or a complex salt thereof, or an iron salt or a complex iron salt.

The internal nuclei thus formed may be provided with the first coating layer by routine methods such as halogen substitution and coating of an additional silver halide. Halogen substitution may be accomplished by adding an aqueous solution of an iodide into the reactor where the internal nuclei have formed. For further information on this method, see U.S. Pat. Nos. 2,592,250, 4,075,020, Japanese Patent Application (OPI) No. 127549/1980, etc. Coating of an additional silver halide over the internal nuclei may be accomplished by simultaneous addition of an aqueous solution of a halide and an aqueous solution of silver nitrate. For further information on this method, see Japanese Patent Application (OPI) No. 22408/1978, Japanese Patent Publication No. 13162/1968, J. Proto, Sci., 24, 198 (1976).

After the first coating layer has been formed on the surface of internal nuclei, the second coating layer may be formed on the first layer by halogen substitution, coating of an additional silver halide, or any of the methods that are employed to form the first coating layer.

In preparing the silver halide grains for use in the present invention, any unwanted soluble salts may be removed from the emulsion in which the second coating layer has been formed by precipitation or ripened physically and, if required, from the emulision in which internal nuclei or the first coating layer has been formed. For this purpose, noodle washing or flocculation washing may be employed; in noodle washing, additional gelatin is added to the emulsion, which will solidify into a jelly upon cooling can can be washed in the form of noodles; in flocculation washing, inorganic salts, anionic surfactants, anionic polymers (e.g. polystyrene sulfonic acid), or gelatin derivatives (e.g. acylated gelatin and carbamoylated gelatin) are used as flocculating agents.

The silver halide grains used in a silver halide emulsion may be of the surface image type which forms a latent image predominatntly on the grain surface or of the internal image type which forms a latent image predominantly in the interior of the grain.

The silver halide grains used in the present invention may have regular cyrstallographic shapes such as a cube, octahedron and a tetradecahedron; alternatively, they may have anomalous shapes such as being spherical or tabular. These grains may have {100} and {111} faces in any proportion. The grains may have a combination of these crystallographic shapes, or they may be a mixture of grains having various crystallographic shapes. Preferably, the silver halide emulsion that is used in the practice of the present invention contains silver halide grains at least the surface of which has {110} crystal faces that are substantially composed of silver bromide or silver iodobromide. Such a preferably silver halide emulsion can be prepared by a conventional method of producing a silver halide emulsion wherein the surfaces of silver halide grains are substantially formed of silver bromide or silver iodobromide, the only modification being such that silver halide grains are formed within a aqueous medium that contains both a hydrophilic protective colloid and a compound that promotes the development of {110} crystal faces. For instances, by allowing grains to form in the presence of 1-phenyl-5-mercaptotetrazole which is conventionally used to stop the growth of silver halide grains, the development of {110} crystal planes is appreciably promoted to thereby produce a photographic emulsion that contains {110} faced silver bromide or silver iodobromide grains.

Mercaptoazoles are preferably used as crystal control compounds, and mercaptotetrazoles and mercaptothiadiazoles are particularly preferable. These crystal control compounds may be added at any stage prior to the completion of formation of silver halide grains (or prior to the completion of Ostwald ripening). The period of grain formation consists of two stages, one defined by the start of addition of silver and halide ions and by the time when the formation of additional nuclei is substantially finished (this stage may be referred to as the period of nucleation) and the one which follows the period of nucleation and during which grains continue to grow with the formation of additional nuclei being substantially absent (this stage may be referred to as the period of grain growth). The crystal control compounds are preferably added during the growth of silver halide grains. The formation of an excessive number of fine grains can be prevented most effectively by adding crystal control compounds after the completion of nucleation and prior to the completion of grain growth. On the other hand, fine silver halide grains can effectively be produced by using the crystal control compounds either during or before the period of nucleation.

The crystal control compounds may be charged into the reactor before the start of silver halide grain preparation; alternatively, they may be added after crystal precipitation has begun. In the latter case, they may be added either alone or as a solution in a solvent such as water or an organic solvent (e.g. methanol or ethanol).

The crystal control compounds may be charged into the reactor either alone or together with a silver supply solution (e.g. an aqueous solution of silver nitrate) or as a halide supply solution (e.g. an aqueous solution of a halide).

The crystal control compounds may be added either continuously or intermittently. Effective control of crystallographic surfaces can be achieved if the amount of crystal control compounds added is increased (as by increasing the amount or concentration of the solution in which they are present) as the surface area of silver halide grains is increased.

The proportion of the crystallographic surfaces of silver halide grains taken by {110} faces can be readily modified by changing the amount of crystal control compounds added. For instance, the proportion of {110} faces will increase as an increased amount of crystal control compound is added and it reaches a maximum level within the range of addition to be specified below. If this range is exceeded, the ratio of {100} planes to {110} planes will increase While the amount of crystal control compound added will vary with factors such as the type of compound used, the conditions of emulsion preparation, its halide composition and the grain size, a preferable range is from $5\times10^{-5}$ to $5\times10^{-2}$ moles per mole of silver halide. A more preferable range is from $1\times10^{-4}$ to $1\times10^{-2}$ moles per mole of silver halide, with the range of $3\times10^{-4}$ to $6\times10^{-3}$ moles being most preferred.

As already mentioned, the silver halide grains suitable for use in the present invention have {110} crystallographic faces, and at least 20% of the total surface area of the grains is preferably covered with {110} faces. It is particularly preferable that at least 80% of the total surface area of the grains is covered with {110} faces. The presence and proportion of such {110} faces may be checked by observation under an electron microscope or by dye adsorption.

The silver halide emulsion used in the present invention preferably contains at least 30 wt %, more preferably at least 50 wt %, of silver halide grains having the above-defined proportion of {110} surfaces.

The silver halide grains used in the present invention generally have an average grain size (the grain size being expressed as the diameter of an equivalent circle having the same area as the projected area of a grain) of no more than 5 μm, and the range of 0.1–5 μm is preferable, with the range of 0.4–2 μm being more preferable.

The silver halide emulsion used in the present invention may have any grain size distribution. It may be a polydispersed emulsion having a broad size distribution or it may consist of one or more monodispersed emulsions having a narrow size distribution. The term "monodispersed emulsion" as used herein means such an emulsion that the standard deviation of grain size distribution as divided by the average grain size is no more than 0.20. The grain size refers to the diameter of a silver halide grain if it is spherical, or to the diameter of an equivalent circle having the same area as that of the projected image of a non-spherical grain. A polydispersed emulsion may be used in admixture with a monodispersed emulsion.

The silver halide emulsion used in the present invention may be a mixture of two or more separately prepared silver halide emulsions.

The silver halide emulsion used in the present invention may be optically sensitized for a desired wavelength region using any of the dyes that are commonly known as sensitizing dyes in the photographic industry. Sensitizing dyes may be used either independently or in combination with themselves. Together with sensitizing dyes, dyes that do not themselves have any spectral sensitizing action or compounds that are substantially incapable of absorbing visible light and which will enhance the sensitizing action of sensitizing dyes may be contained in the emulsion.

Useful sensitizing dyes include cyanine dyes, merocyanine dyes, complex cyanine dyes, complex merocyanine dyes, holopolar cyanine dyes, hemicyanine dyes, styryl dyes and hemioxanole dyes. Particularly useful sensitizing dyes are cyanine dyes, merocyanine dyes and complex merocyanine dyes. These dyes may contain any of the basic heterocyclic nuclei that are commonly employed in cyanine dyes; they include pyrroline, oxazoline, thiazoline, pyrrole, oxazole, thiazole, selenazole, imidazole, tetrazole, and pyridine nuclei, as well as those to which an alicyclic hydrocarbon ring is fused; those to which an aromatic hydrocarbon ring is fused as in the case of indolenine, benzindolenine, indole, benzoxazole, naphthoxazole, benzothiazole, naphthothiazole, benzoselenazole, benzimidazole, and quinoline nuclei. These nuclei may be substituted on carbon atoms.

Merocyanine or complex merocyanine dyes may contain nuclei having a ketomethylene structure, such as pyrazolin-5-one, thiohydantoin, 2-thioxazolidin-2,4-dione, thiazolidin-2,4-dione, rhodanine, thiobarbituric acid, and other 5- or 6-membered heterocyclic nuclei.

Illustrative sensitizing dyes that are useful in blue-sensitive silver halide emulsion layers are described in West German Pat. Nos. 929,080, U.S. Pat. No. 2,231,658, 2,493,748, 2,503,776, 2,519,001, 2,912,329, 3,656,959, 3,672,897, 3,694,217, 4,025,349, 4,046,572, British Patent No. 1,242,588, and Japanese Patent Publication Nos. 14030/1969 and 24844/1977. Typical sensitizing dyes that are useful in green-sensitive silver halide emulsions include cyanine, merocyanine or complex cyanine dyes of the types described in U.S. Pat. Nos. 1,939,201, 2,072,908, 2,739,149, 2,945,763, and British Patent No. 505,979. Typical sensitizing dyes that are useful in red-sensitive silver halide emulsions include cyanine, merocyanine or complex cyanine dyes of the types described in U.S. Pat. No. 2,269,234, 2,270,378, 2,442,710, 2,454,629, and 2,776,280. Other examples of useful sensitizing dyes in green- or red-sensitive silver halide emulsions are cyanine, merocyanine or complex cyanine dyes of the types described in U.S. Pat. Nos. 2,213,995, 2,493,748, 2,519,001, and West German Patent No. 929,080.

The above-mentioned sensitizing dyes may be used either singly or in combination. Sensitizing dyes are often used in combination for the purpose of super-sensitization, as typically shown in Japanese Patent Publication Nos. 4932/1968, 4933/1968, 4936/1968, 32753/1969, 25831/1970, 26474/1970, 11627/1971, 18107/1971, 8741/1972, 11114/1972, 25379/1972, 37443/1972, 28293/1973, 38406/1973, 38407/1973, 38408/1973, 41203/1973, 41204/1973, 6207/1974, 40662/1975, 12375/1978, 34535/1979 and 1569/1980; Japanese Patent Application (OPI) Nos. 33220/1975, 33828/1975, 38526/1975, 107127/1976, 115820/1976, 135528/1976, 151527/1976, 23931/1977, 51932/1977, 104916/1977, 104917/1977, 109925/1977, 110618/1977, 80118/1979, 25728/1981, 1483/1982, 10753/1983, 91445/1983, 153926/1983, 114533/1984, 116645/1984, and 116647/1984; U.S. Pat. Nos. 2,688,545, 2,977,229, 3,397,060, 3,506,443, 3,578,447, 3,672,898, 3,679,428, 3,769,301, 3,814,609, and 3,837,862.

Sensitizing dyes may be used together with dyes that do not themselves exhibit a spectral sensitizing activity or substances that are substantially incapable of absorbing visible light but which achieve supersensitization, and these dyes or substances include the condensation products of aromatic organic acids and formaldehyde (as shown in U.S. Pat. No. 3,437,510), cadmium salts, azaindene compounds, and aminostilbene compounds (as shown in U.S. Pat. Nos. 2,933,390 and 3,635,721). The combinations described in U.S. Pat. No. 3,615,613, 3,615,641, 3,617,295 and 3,635,721 are particularly useful.

The present invention is preferably applied with chemically sensitized silver halide grains. Chemical sensitization of silver halide grains may be achieved by the methods described in Die Grundlagen der Photographischen Prozesse mit Silberhalogeniden, ed. by H. Frieser, Akademische Veragaesellschaft, 1968, pp. 675–734.

According one preferred embodiment of the present invention, at least one sensitizing dye selected from the group of compounds of the following general formulas (I), (II) and (III) is incorporated in the light-sensitive silver halide emulsion layer already defined. Any one of these compounds achieves orthochromatic sensitization and, hence, is effective in attaining further improvement in resistance to pressure desensitization and abrasion blackening. The regular type emulsion employs large grains for providing the "toe" region in a sensitometric curve where high sensitivity is required and such large grains are rather susceptible to pressure desensitization and abrasion blackening. On the other hand, ortho type emulsions are possessed of the high sensitivity achieved by dye sensitization and the silver halide grains used in these emulsions can be made smaller in size. As a result, further improvement is achieved in resistance to pressure desensitization and abrasion blackening.

The general formulas (I) to (III) are shown below:

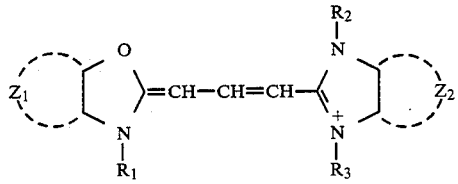

(I)

$(X_1^-)_{n-1}$

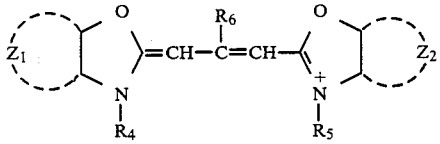

(II)

$(X_2^-)_{n-1}$

-continued

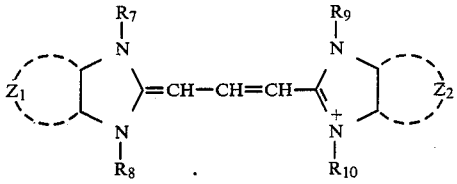

(III)

$(X_3^-)_{n-1}$ where $X_1^-$, $X_2^-$ $X_3^-$ are each an anion, $Z_1$ and $Z_2$ each signifies the group of nonmetal atoms necessary to complete a substituted or unsubstituted carbon ring, n is 1 or 2, provided that n=1 when an intramolecular salt is formed.

In formula (I), $R_1$, $R_2$ and $R_3$ are each a substituted or unsubstituted alkyl, alkenyl or aryl group, provided that at least one of $R_1$ and $R_3$ is a sulfoalkyl or carboxyalkyl group.

In formula (II), $R_4$ and $R_5$ are the same as $R_1$ and $R_3$, and $R_6$ is a hydrogen atom, a lower alkyl group or an aryl group.

In formula (III), $R_7$ and $R_9$ are each a substituted or unsubstituted lower alkyl group, and $R_8$ and $R_{10}$ are each a lower alkyl group, a hydroxyalkyl group, a sulfoalkyl group or a carboxyalkyl group.

In a preferred embodiment of the present invention, at least one of the compounds of formulas (I) to (III) is used to effect color sensitization.

The compounds of formulas (I) to (III) are hereunder described in further detail.

In the case where $R_1$, $R_2$ and $R_3$ in formula (I) each denotes a substituted or unsubstituted alkyl group, specific examples are lower alkyl groups such as methyl, ethyl, n-propyl and butyl. An example of the substituted alkyl group is vinylmethyl. Illustrative hydroxyalkyl groups are 2-hydroxyethyl and 4-hydroxybutyl; illustrative acetoxyalkyl groups are 2-acetoxyethyl and 3-acetoxybutyl; illustrative carboxyalkyl groups are 2-carboxyethyl, 3-carboxypropyl, and 2-(2-carboxyethoxy)ethyl; and illustrative sulfoalkyl groups include 2-sulfoethyl, 3-sulfopropyl, 3-sulfobutyl, 4-sulfobutyl, and 2-hydroxy-3-sulfopropyl. In the case where $R_1$, $R_2$ and $R_3$ denote an alkenyl group, specific examples are allyl, butinyl, octenyl and oleyl. In the case where $R_1$, $R_2$ and $R_3$ signify an aryl group, specific examples are phenyl and carboxyphenyl. As already mentioned, however, at least one of $R_1$, $R_2$ and $R_3$ is a sulfoalkyl or carboxyalkyl group.

Examples of anion represented by $X_1^-$ in formula (I) include chloride, bromide, iodide, thiocyanate, sulfate, perchlorate, p-toluenesulfonate and ethyl sulfate ions.

Typical examples of the compound of formula (I) are specifically listed below but it should be understood that the scope of the present invention is by no means limited by these examples.

Illustrative compounds of formula (I)

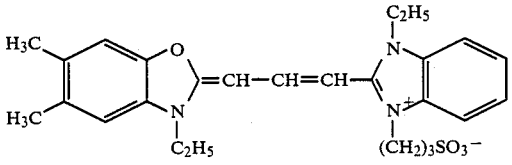

(1)

-continued
Illustrative compounds of formula (I)
(2)
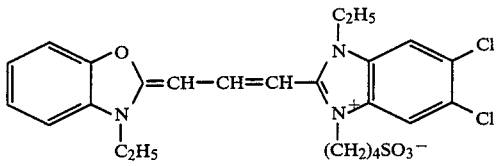
(3)
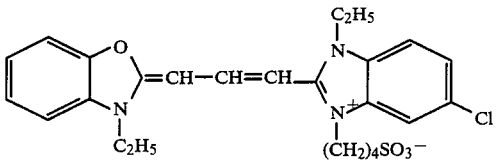
(4)
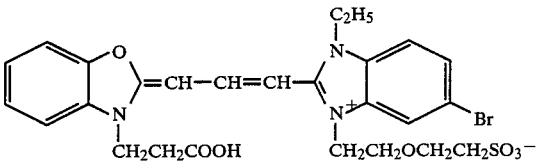
(5)
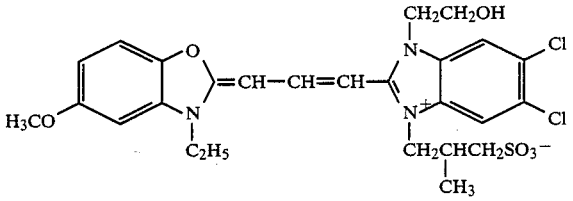
(6)
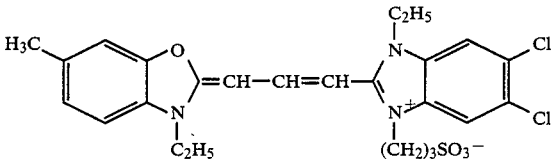
(7)
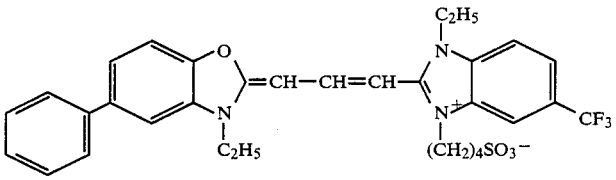
(8)
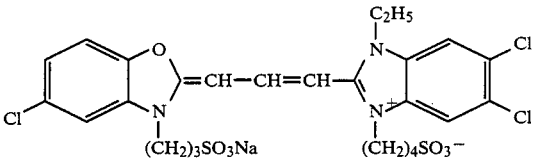
(9)
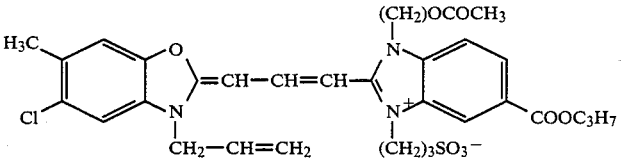

-continued
Illustrative compounds of formula (I)
(10)
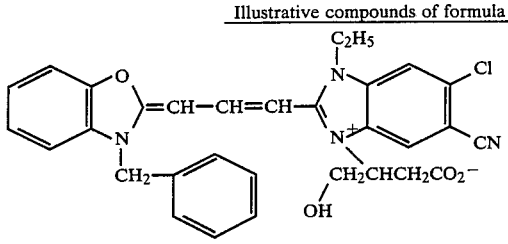
(11)
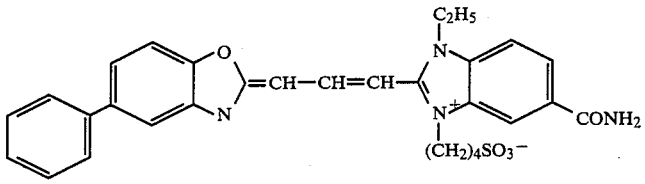
(12)
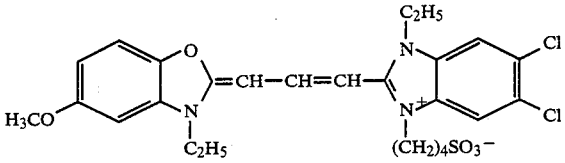
(13)
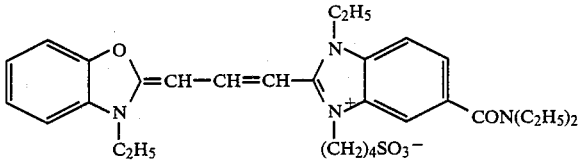
(14)
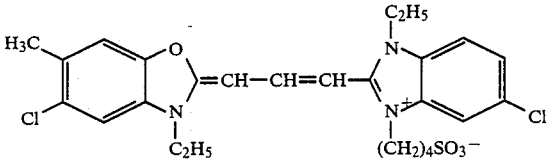
(15)
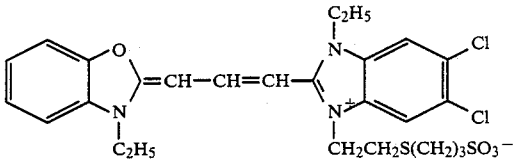
(16)
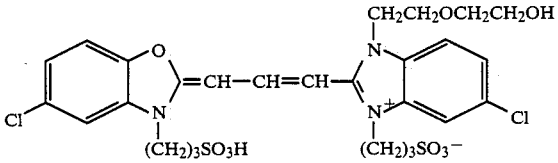
(17)
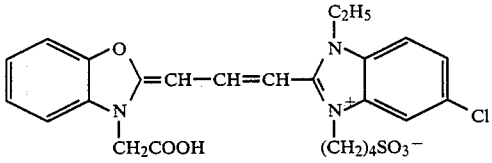
(18)
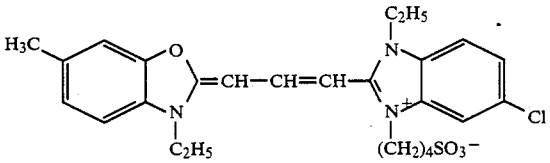

-continued
Illustrative compounds of formula (I)
(19)
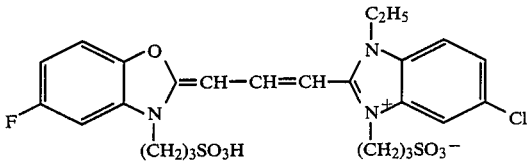
(20)
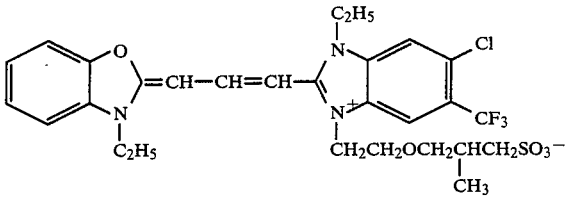
(21)
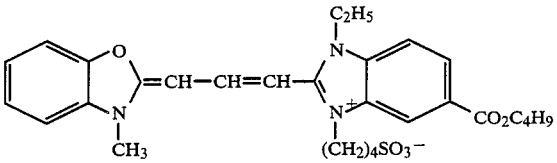
(22)
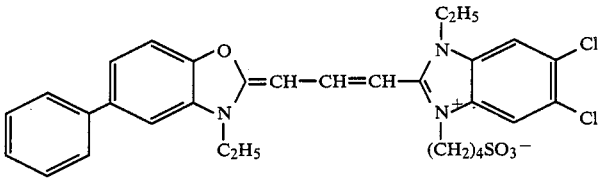
(23)
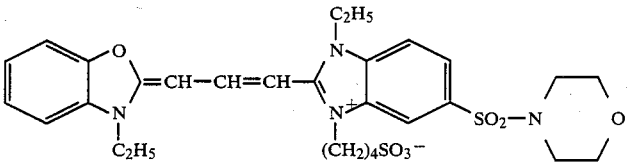
(24)
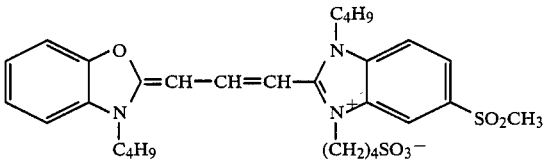
(25)
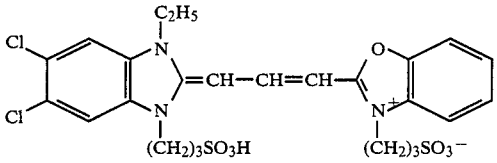
(26)
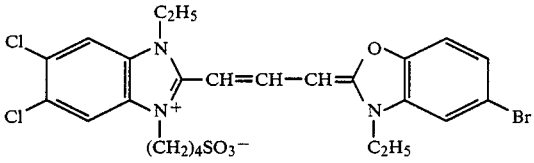
(27)
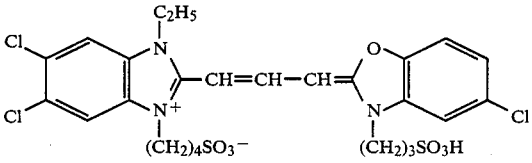

-continued
Illustrative compounds of formula (I)
(28)
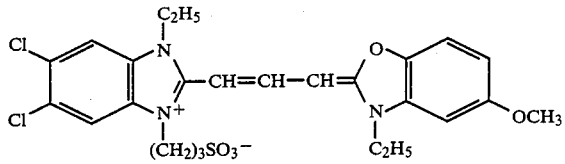
(29)
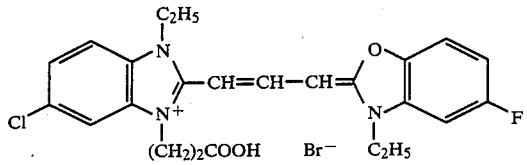
(30)
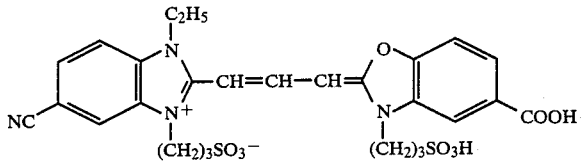
(31)
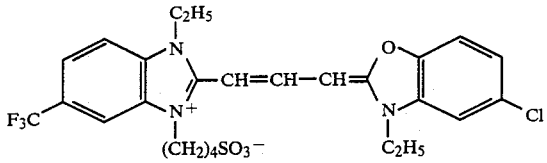
(32)
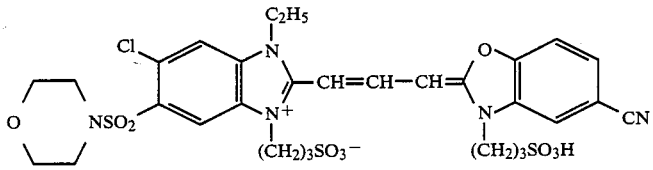
(33)
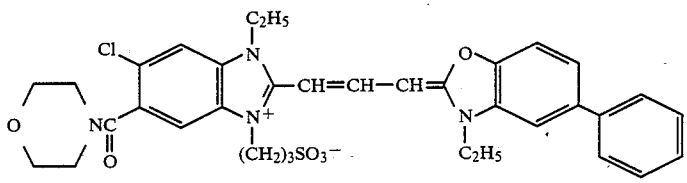
(34)
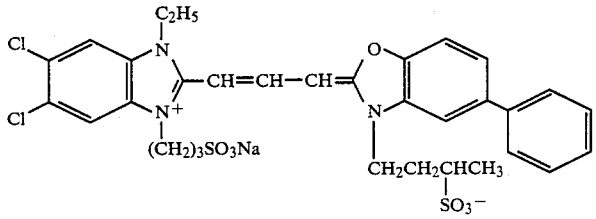
(35)
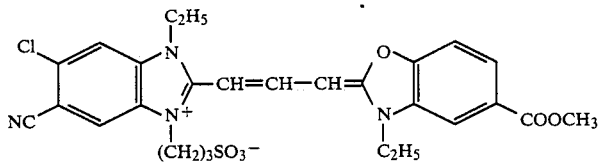
(36)
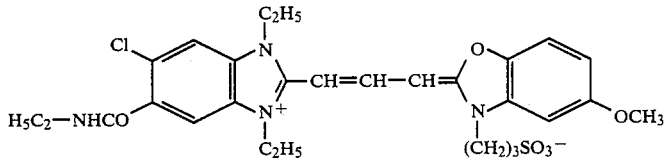

-continued

Illustrative compounds of formula (I)

(37)

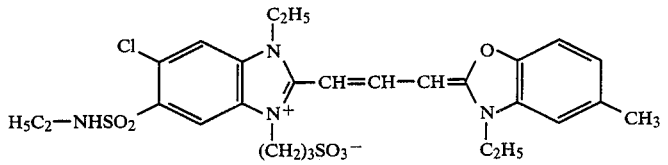

(38)

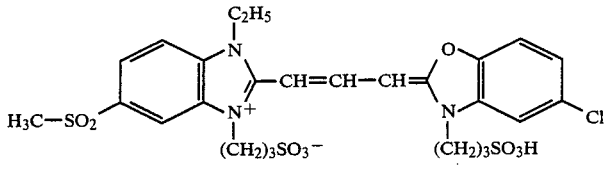

(39)

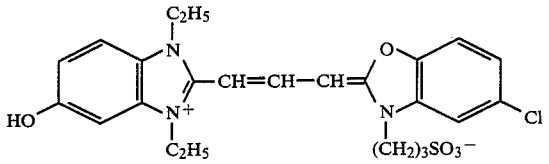

(40)

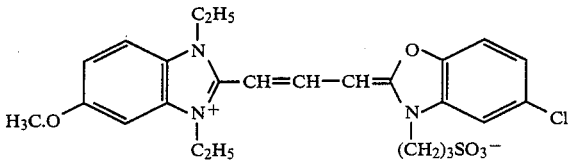

(41)

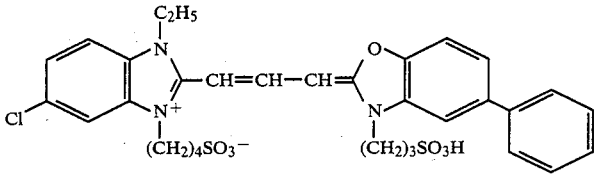

In formula (II), $R_6$ signifies a hydrogen atom, a lower alkyl group, or an aryl group. Illustrative lower alkyl groups include methyl, ethyl, propyl and butyl; an illustrative aryl group is phenyl. In formula (II), $R_4$ and $R_5$ may be illustrated by those which are given for $R_1$ and $R_3$ in connection with the description of formula (I). Anions represented by $X_2^-$ may be the same as those given for $X_1^-$ in relation to formula (I).

Typical examples of the compound of formula (II) are specifically listed below but it should be understood that the scope of the present invention is by no means limited by these examples.

Illustrative compounds of formula (II):

(42)

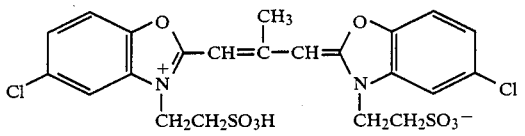

(43)

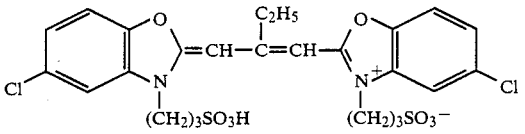

(44)

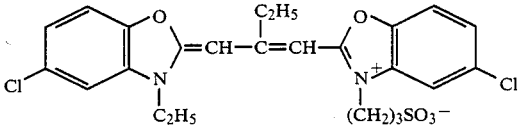

-continued
Illustrative compounds of formula (II):
(45)
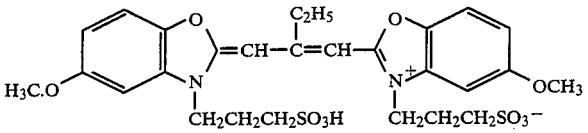
(46)
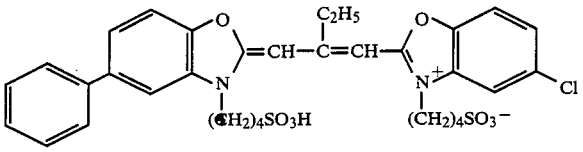
(47)
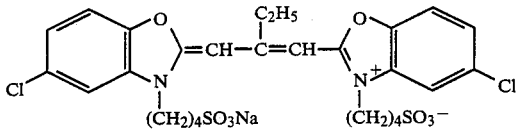
(48)
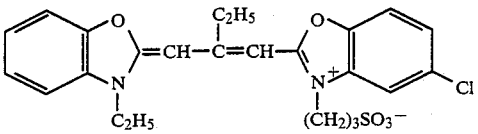
(49)
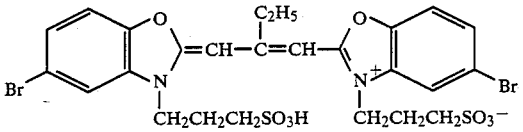
(50)
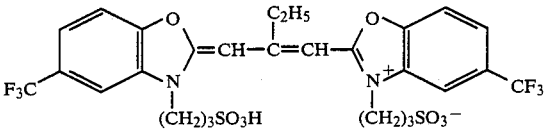
(51)
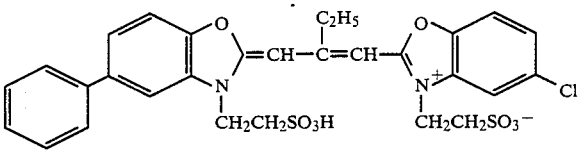
(52)
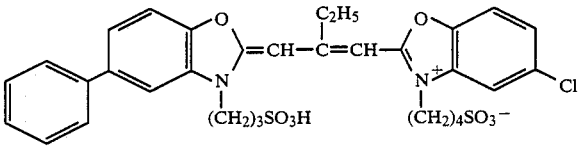
(53)
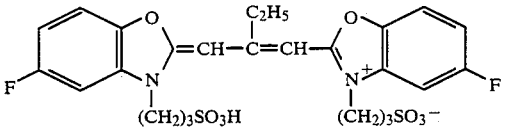
(54)
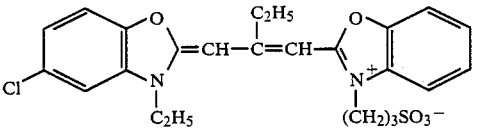

-continued
Illustrative compounds of formula (II):
(55)
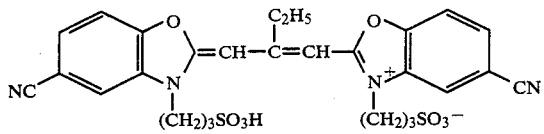
(56)
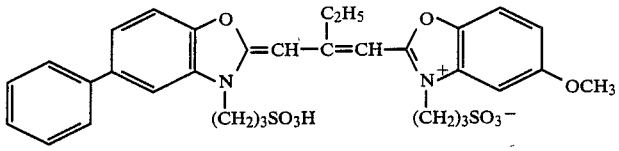
(57)
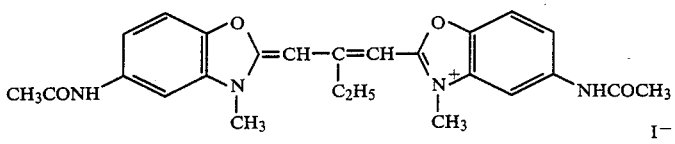
(58)
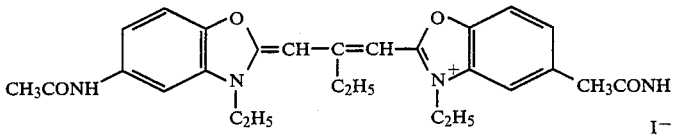
(59)
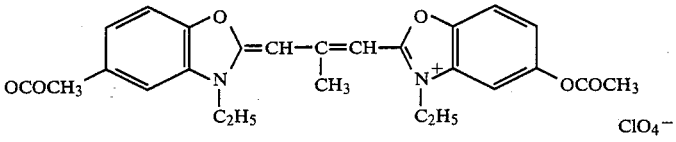
(60)
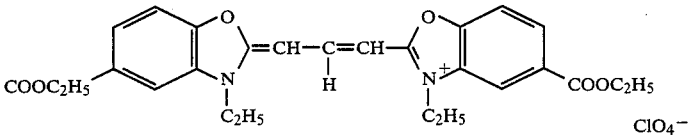
(61)
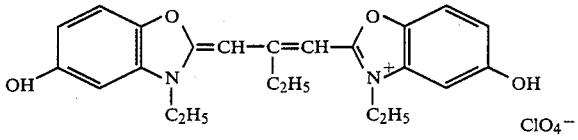
(62)
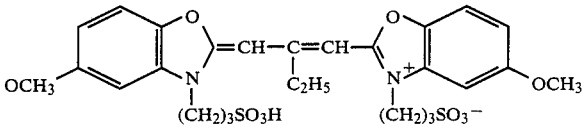
(63)
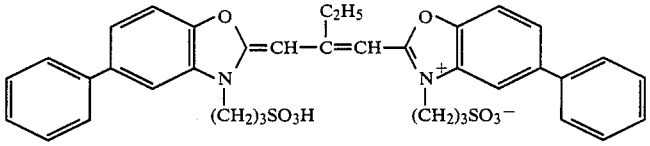
(64)
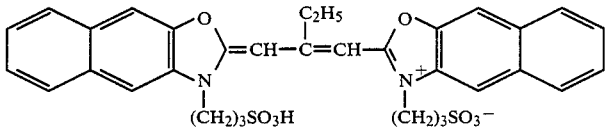

-continued

Illustrative compounds of formula (II):

(65)

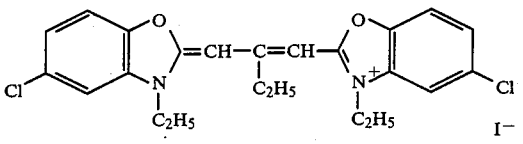

In the case where $R_7$ and $R_9$ in formula (III) signifies a lower alkyl group, it may be exemplified by methyl, ethyl, propyl, butyl, etc. Substituted alkyl groups as $R_7$ and $R_9$ may be the same as those given for $R_1$ to $R_3$ in connection with the description of formula (I). Lower alkyl groups as $R_8$ and $R_{10}$ may be the same as those given for $R_7$ and R9. Hydroxyalkyl, sulfoalkyl and carboxyalkyl groups as $R_8$ and $R_{10}$ may be the same as those given for $R_1$ to $R_3$ in relation to formula (I). Anions represented by $X_3^-$ may be the same as those given for $X_1^-$ in relation to formula (I).

Typical examples of the compound of formula (III) are specifically listed below but it should be understood that the scope of the present invention is by no means limited by these examples.

Illustrative compounds of formula (III):

(66)

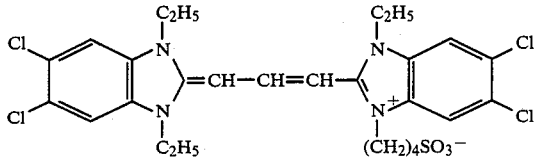

(67)

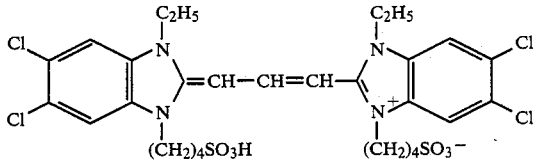

(68)

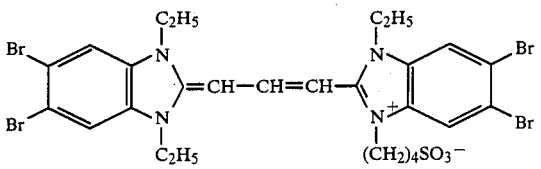

(69)

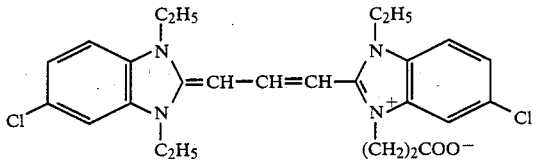

(70)

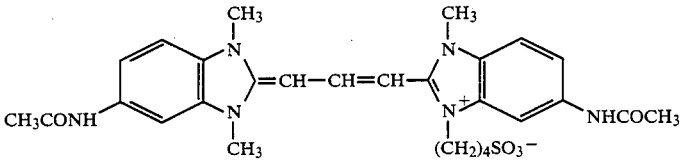

(71)

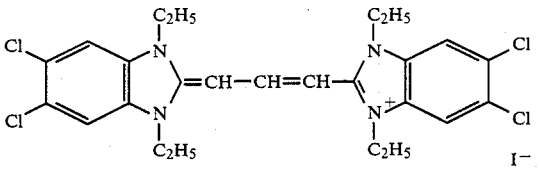

(72)

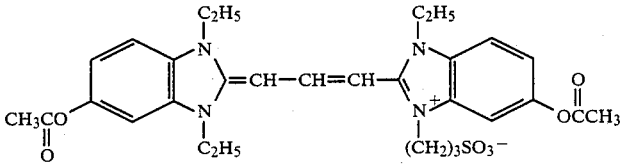

-continued

Illustrative compounds of formula (III):

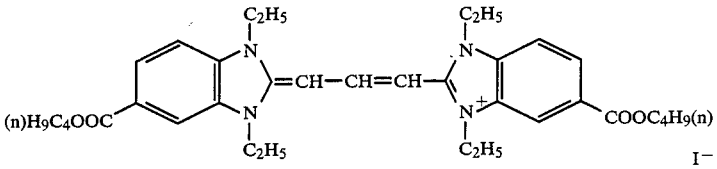

(73)

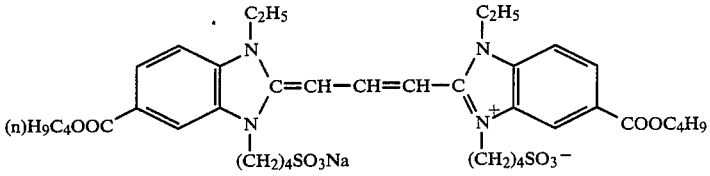

(74)

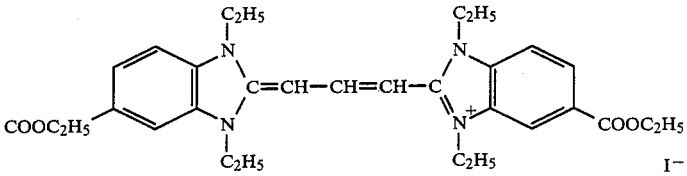

(75)

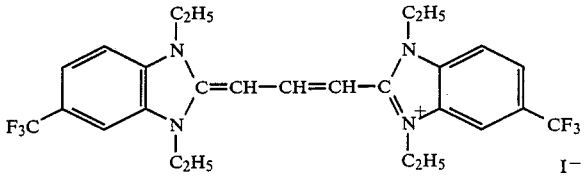

(76)

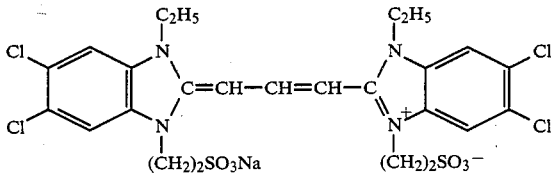

(77)

The carbon ring completed by $Z_1$ and $Z_2$ in each of the formulas (I) to (III) is preferably a substituted or unsubstituted benzene or naphthalene ring.

Specific disclosure of the compounds of formulas (I) to (III) is also found in Japanese Patent Application (OPI) No. 80237/1986 and any of the disclosed compounds is preferably employed in the practice of the present invention.

The compound of formula (I) or (II) or (III) is preferably added in a total amount of 10–900 mg per mole of silver halide, more preferably within the range of 100–700 mg. The range of 150–600 mg is most preferable.

The compounds of formulas (I) to (III) may be added at any stage of the production of a light-sensitive material. For instance, they may be added either before, or during, or after chemical ripening at any time that precedes the coating operation.

In order to prevent the occurrence of fogging or stabilize the photographic performance during manufacture, storage or processing of the light-sensitive material of the present invention, various compounds may be incorporated in the photographic emulsion that is employed in light-sensitive silver halide emulsions.

As will be described later in this specification, the light-sensitive material of the present invention may contain filter dyes in hydrophilic colloidal layers; it may also contain water-soluble dyes for achieving various purposes such as anti-irradiation and anti-halation. Such dyes may be used with mordants and illustrative mordants are cationic polymers for the dyes.

A protective layer is preferably used in the silver halide photographic material of the present invention. The protective layer is a layer formed of a hydrophilic colloid which may be selected from various types. The protective layer may be a single- or multi-layered.

The silver halide photographic material of the present invention may contain a matting and/or a leveling agent in either emulsion layers or in the protective layer, preferably in the protective layer (for details of the matting agent, see below).

The anti-foggant and stabilizer described above may be selected from among the following compounds: the pentazaindenes described in U.S. Pat Nos. 2,713,541, 2,743,180 and 2,743,181; the tetrazaindenes described in U.S. Pat. Nos. 2,716,062, 2,444,607, 2,444,605, 2,756,147, 2,835,581, 2,852,375, and Research Disclosure No. 14851; the triazindenes described in U.S. Pat. No. 2,772,164; the azaindenes such as polymerized azaindenes described in Japanese Patent Application (OPI) No. 211142/1982; quaternary onium salts such as the thiazolium salts described in U.S. Pat. Nos. 2,131,038, 3,342,596 and 3,954,478, the pyrylium salt described in U.S. Pat. No. 3,148,067, and the phosphonium salt described in Japanese Patent Publication No. 40665/1975; mercapto-substituted heterocyclic compounds such as the mercaptotetrazoles, mercaptotriazoles and mercaptodiazoles described in U.S. Pat. Nos. 2,403,927, 3,266,897, 3,708,303, and Japanese Patent Application (OPI) No. 135835/1980 and 71047/1984, the mercaptothiazoles described in U.S. Pat. No. 2,824,001, the mercaptobenzothiazoles and mercaptobenzimidazoles described in U.S. Pat. No. 3,397,987, the mercaptoxadiazoles described in U.S. Pat. No. 2,843,491, and the mercaptothiadiazoles described in U.S. Pat. No. 3,364,028; polyhydroxybenzenes such as the catechols described in U.S. Pat. No. 3,236,652 and Japanese Patent Publication No. 10256/1968, the resorcins described in Japanese Patent Publication No. 44413/1981, and the gallic acid esters described in Japanese Patent Publication No. 4133/1968; heterocyclic compounds such as azoles illustrated by the tetrazoles described in West German Pat. No. 1,189,380, the triazoles described in U.S. Pat. No. 3,157,509, the benzotriazoles described in U.S. Pat. No. 2,704,721, the urazoles described in USP 3,287,135, the pyrazoles described in U.S. Pat. No. 3,106,467, the indazoles described in U.S. Pat. No. 2,271,229, and the polymerized benzotriazoles described in Japanese Patent Application (OPI) No. 90844/1984, the pyrimidines described in U.S. Pat. No. 3,161,515, the 3-pyrazolidones described in U.S. Pat. No. 2,751,297, and the polymerized pyrrolidones (or polyvinyl pyrrolidones) described in U.S. Pat. No. 3,021,213; a variety of inhibitor precursors of the types described in Japanese Patent Application (OPI) Nos. 130929/1979, 137945/1984, 140445/1984, British Pat. No. 1,356,142, and U.S. Pat. No. 3,575,699 and 3,649,267; the sulfinic acid and derivatives thereof described in U.S. Pat. No. 3,047,393; and the inorganic salts described in U.S. Pat. Nos. 2,566,263, 2,839,405, 2,488,709 and 2,728,663.

Gelatin is advantageously used as a binder (or protective colloid) for silver halide emulsions used in the present invention. Other hydrophilic colloids may be used and they include gelatin derivatives, graft polymers wherein high-molecular weight substances other than gelatin are grafted to gelatin, other proteins, saccharide derivatives, cellulose derivatives, and synthetic hydrophilic high molecular weight substances (either homo- or copolymers).

Gelatin may be treated with lime or acids; it may also be treated with enzymes as described in Bull. Soc. Sci. Photo. Japan, No. 16, p. 30 (1966). Gelatin hydrolyzates or the products of decomposition with enzymes may also be used. Gelatin derivatives may be prepared by reacting gelatin with a variety of compounds such as acid halides, acid anhydrides, isocyanates, bromoacetic acid, alkanesultones, vinylsulfonamides, maleinimide compounds, polyalkylene oxides, and epoxy compounds. Specific examples of gelatin derivatives are given in U.S. Pat. Nos. 2,614,928, 3,132,945, 3,186,846, 3,312,553, British Pat. Nos. 861,414, 1,033,189, 1,005,784, and Japanese Patent Publication No. 26845/1967.

Preferable proteins are albumin and casein; preferable cellulose derivatives are hydroxyethyl cellulose, carboxymethyl cellulose and sulfate esters of cellulose; and preferable saccharide derivatives are sodium alginate and starch derivatives.

Graft polymers of gelatin may be prepared by grafting onto one of the gelatins described above homo- or copolymers of vinyl monomers such as acrylic acid, methacrylic acid, derivatives thereof such as esters and amides, acrylonitrile, and styrene. It is particularly preferable to graft polymers having a certain degree of miscibility with gelatin, such as polyacrylic acid, polyacrylamide, polymethacrylamide, and polyhydroxyalkyl methacrylate. Examples of graft polymers using such grafts are shown in U.S. Pat. Nos. 2,763,625, 2,831,767 and 2,956,884.

Typical synthetic hydrophilic high-molecular weight substances include homo- or copolymers such as polyvinyl alcohol, partially acetaled polyvinyl alcohol, poly-N-vinylpyrrolidone, polyacrylic acid, polymethacrylic acid, polyacrylamide, polyvinylimidazole, and polyvinylpyrazole, and specific examples of these substances are described in West German Patent Application (OLS) No. 2,312,708, U.S. Pat. No. 3,620,751 and 3,879,205, and Japanese Patent Publication No. 7561/1968.

Routine procedures of producing gelatin are well known and are described in, for example, T. H. James, The Theory of the photographic Process, 4th ed., p. 55, 1977, Macmillan Publishing Co., Inc., and Kagaku Shashin Binran (Handbook of Chemical Photography), vol. 1 of two volumes, pp. 72–75, Maruzen Publishing Company.

The gelatin used in the present invention preferably contains no more than 40 wt %, more preferably no more than 35 wt %, of the content having an average molecular weight of no more than 100,000, with the range of 35–20 wt % being particularly preferable. The content of gelatin having an average molecular weight of no more than 50,000 is preferably 30 wt % or less, with the range of 25–10 wt % being particularly preferable.

The average molecular weight of the gelatin used in the present invention is its weight average molecular weight determined by gel permeation chromatography (hereinafter abbreviated as GPC). An example of molecular weight measurement by GPC is specified below.

(1) Column: Sepharose CL4B (Pharmacia Fine Chemicals), 80 $cm^L \times 15$ $nm^\phi$, 35° C.;

(2) Eluant: 0.2 M $CH_3COOH$/0.2 M $CH_2COONa$ in aq. sol.; flow rate, 0.29 mL/mm; Veristar pump (ATTO Corporation):

(3) Detector: UV absorption spectrophotometer ($\lambda_{uv}$, 254 nm);

(4) Sample to be analyzed: gelatin, 25 mg in ab. wt.

The percentage of gelatin taken by the content having an average molecular weight of no more than 100,000 may be determined from a GPC chart as follows: draw a line perpendicular to the baseline from the peak position attained for the o-component (av. mol. wt., 100,000) and calculate the proportion of the total area taken by the area of the lower-molecular weight portion which is situated on the right-hand side of the vertical line.

The following methods (1) to (5) may be used to decrease the content of gelatin that has an average molecular weight of no more than 100,000:

(1) Extract gelatin from starting materials such as bones, hides and skins, with the initially obtained gelatin extract being eliminated;

(2) Carry out gelatin production, with the temperature for processing gelatin solution being held at 40° C. or below at any stage of the process including gelatin extraction and the drying step;

(3) Dialyze a gelatin gel against cold (15° C.) water [see The Journal of Photographic Science, 23, 33, (1975)];

(4) Perform fractionation using isopropyl alcohol [see G. Siainsby, Discussion of Faraday's Society, 18, 288 (1954)]; and (5) Perform adsorption with a high-molecular weight adsorbent such as a styrene-divinylbenzene copolymer resin.

By employing these methods either singly or in combination, a gelatin with no more than 40 wt % of the content having an average molecular weight of 100,000 or less can be attained.

If a gelatin whose content of a component having an average molecular weight of no more than 100,000 is 40 wt % or less is used in a hydrophilic colloidal layer, development and subsequent photographic processing can be achieved automatically with the formation of scum being substantially absent. Examples of the hydrophilic colloidal layer are silver halide emulsion layers, surface protective layers, intermediate layers and filter layers.

If gelatin is used as a binder for the silver halide emulsion used in the present invention, it may have any jelly strength but a value of at least 250 g is preferable. The term "jelly strength" as used herein means the strength of a gelatin jelly measured by the PAGI method described on page 5 of "Shashinyo Gelatin Shikenho (Methods of Testing Photographic Gelatin)", published by Joint Council for Methods of Testing Photographic Gelatin, Japan, 1970.

As for the gelatin having a jelly strength of at least 250 g, reference may be had to Japanese Patent Publication No. 43777/1976, and Japanese Patent Application (OPI) Nos. 9518/1978 and 13413/1978. This gelatin may be acid-treated gelatin or lime-treated gelatin. The gelatin having a jelly strength of at least 250 g is desirably used in all of the hydrophilic colloidal layers including silver halide emulsion layers, intermediate layers and surface protective layers. If this is not possible, the gelatin is desirably used in the outermost layer or any other layers that are situated as close as possible to the surface layer.

In the present invention, a gelatin having a jelly strength of at least 250 g is used as a binder and this means that at least 50 wt %, preferably at least 80 wt %, of the hydrophilic colloidal layer in which the gelatin is used is taken by the gelatin having a jelly strength of 250 g or more.

Photographic emulsion layers and other hydrophilic colloidal layers in the light-sensitive material using the silver halide emulsion defined by the present invention may be hardened with one or more hardening agents that produce a stronger film by crosslinking the molecules of the binder (or protective colloid). Hardening agents may be added in amounts that are capable of hardening the light-sensitive material to such an extent that there is no need to add any hardening agent to the processing solutions. It is of course possible to incorporate hardening agents in the processing solutions.

Illustrative hardeners are listed below: aldehyde compounds; aziridine compounds (as described in PB Report 19,921, U.S. Pat. Nos. 2,950,197, 2,964,404, 2,983,611, and 3,271,175, Japanese Patent Publication No. 40898/1971, and Japanese Patent Application (OPI) No. 91315/1975); isoxazole compounds (as described in U.S. Pat. No. 331,609); epoxy compounds (as described in U.S. Pat. No. 3,047,394, West German Pat. No. 1,085,663, British Pat. No. 1,033,518, and Japanese Patent Publication No. 35495/1973); vinylsulfone compounds (as described in PB Report 19,920, West German Patent Nos. 1,100,942, 2,337,412, 2,545,722, 2,635,518, 2,742,308, 2,749,260, British Pat. No. 1,251,091, Japanese Patent Application No. 54236/1970, 110996/1973, and U.S. Pat. Nos. 3,539,644 and 3,409,911); acryloyl compounds (as described in Japanese Patent Application No. 27949/1973 and U.S. Pat. No. 3,630,720); carbodiimide compounds (as described in U.S. Pat. Nos. 2,938,892, 4,043,818, 4,061,499, Japanese Patent Publication No. 38715/1971 and Japanese Patent Application No. 15095/1974); triazine compounds (as described in West German Patent Nos. 2,410,973, 2,553,915, U.S. Pat. No. 3,325,287, and Japanese Patent Application (OPI) No. 12722/1977); high-molecular weight compounds (as described in British Pat. No. 822,061, U.S. Pat. No. 3,623,878, 3,396,029, 3,226,234, and Japanese Patent Publication Nos. 18578/1972, 18579/1972 and 48896/1972); as well as maleimide, acetylene, methanesulfonate ester compounds, and N-methylol compounds. These hardening agents may be used either singly or in combination. Useful combinations are described in such prior patents as West German Pat. Nos. 2,447,587, 2,505,746, 2,514,245, U.S. Pat. Nos. 4,047,957, 3,832,181, 3,840,370, Japanese Patent Application (OPI) Nos. 43319/1973, 3062/1975, 127329/1977, and Japanese Patent Publication No. 2364/1973.

For the purpose of providing increased flexibility, plasticizers may be incorporated in silver halide emulsion layers and/or other hydrophilic colloidal layers in a light-sensitive material using the silver halide emulsion defined in accordance with the present invention. Preferable plasticizers are described in such prior patents as Japanese Patent Application (OPI) No. 63715/1973, British Pat. No. 1,239,337, and U.S. Pat. Nos. 306,470, 2,327,808, 2,759,821, 2,772,166, 2,835,582, 2,860,980, 2,865,792, 2,904,434, 2,960,404, 3,003,878, 3,033,680, 3,173,790, 3,287,289, 3,361,565, 3,397,988, 3,412,159, 3,520,694, 3,520,758, 3,615,624, 3,635,853, 3,640,721, 3,656,956, 3,692,753, and 3,791,857. A particularly preferable plasticizer is trimethylolpropane. When diols or polyols such as trimethylolpropane are used, their amount is preferably within the range of 0.01–100 wt %, more preferably 0.1–100 wt %, most preferably 0.1–10 wt %, of gelatin.

For attaining various purposes such as improvement in dimensional stability, dispersions (or latices) of water-insoluble or slightly water-soluble synthetic polymers may be contained in photographic emulsion layers or other hydrophilic colloidal layers in a light-sensitive material using the silver halide emulsion defined in accordance with the present invention. Preferable examples of the slightly water-soluble synthetic polymers are described in such prior patents as British Pat. Nos. 807,894, 1,186,699, Japanese Patent Publication Nos. 43125/1973, 25499/1974, and U.S. Pat. Nos. 2,376,005, 2,853,457, 2,956,884, 3,062,674, 3,287,289, 3,411,911, 3,488,708, 3,525,620, 3,607,290, 3,635,715, and 3,645,740.

Bleaching accelerators or compounds such as development accelerators and retarders that modify the developability of light-sensitive materials may be incorporated in silver halide emulsion layers and/or other hydrophilic colloidal layers in a light-sensitive material that uses the silver halide emulsion defined by the present invention. Compounds that are preferably used as development accelerators are listed in Research Disclosure No. 17463, XXI, B - D, and those which are preferably used as development retarders are shown in XXI, E of the same reference. Black-and-white developing agents and/or precursors thereof may be used for accelerating the development or attaining other objects.

In order to provide increased sensitivity or contrast or accelerate the development, photographic emulsion layers in a photographic material using the silver halide emulsion defined by the present invention may contain various compounds such as polyalkylene oxide or derivatives thereof such as ethers, esters or amines, thioether compounds, thiomorpholines, quaternary ammonium compounds, urethane derivatives, urea derivatives, and imidazole derivatives.

A light-sensitive material using the silver halide emulsion defined by the present invention may contain a brightening agent for the purpose of highlighting the whiteness of the background while hiding its coloration. Preferable compounds for use as brightening agents are stilbene, triazine, imidazolone, pyrazoline, triazole, coumarin, acetylene, oxazole and oxadiazole compounds. These brightening agents are described in such prior patents as U.S. Pat. Nos. 2,571,706, 2,581,057, 2,618,636, 2,702,296, 2,713,054, 2,715,630, 2,723,197, 3,269,840, 3,513,102, 3,615,544, 3,615,547, 3,684,729, 3,788,854, 3,789,012, British Pat. Nos. 669,590, 672,803, 712,764, Dutch Pat. No. 74,109, German Pat. No. 911,368, German Patent Application (OLS) No. 2,525,680, and Japanese Patent Publication No. 7127/1959. These compounds may be water-soluble; if they are water-insoluble, they may be used in the form of dispersions.

Auxiliary layers such as filter layers, anti-halation layers and/or anti-irradiation layers may be employed in a light-sensitive material using the silver halide emulsion defined by the present invention. These layers and/or emulsion layers may contain dyes that will be bleached or flow out of the light-sensitive material during development and subsequent processing.

Filter dyes or other dyes that are used to achieve various purposes such as prevention of irradiation include oxanole dyes, hemioxanole dyes, merocyanine dyes, cyanine dyes, styryl dyes, and azo dyes. Particularly useful dyes are oxanole, hemioxanole and merocyanine dyes. Specific examples of usable dyes are shown in many references such as: West German Pat. No. 616,007, British Pat. Nos. 584,609, 1,177,429, Japanese Patent Publication Nos. 7777/1951, 22069/1964, 38129/1979, Japanese Patent Application (OPI) Nos. 85130/1973, 99620/1974, 114420/1974, 129537/1974, 28827/1975, 108115/1977, 185038/1972, U.S. Pat. Nos. 1,878,961, 1,884,035, 1,912,797, 2,098,891, 2,150,695, 2,274,782, 2,298,731, 2,409,612, 2,461,484, 2,527,583, 2,533,472, 2,865,752, 2,956,879, 3,004,418, 3,125,448, 3,148,187, 3,117,078, 3,247,127, 3,260,601, 3,282,699, 3,409,433, 3,540,887, 3,575,704, 3,653,905, 3,718,472, 3,865,817, 4,070,352, 4,071,312, PB Report No. 74175, and Photographic Abstract, 1, 28 ('21).

Silver halide emulsion layers and/or other hydrophilic colloidal layers in the silver halide light-sensitive material of the present invention may contain a matting agent in order to attain various advantages such as reduced gloss, improved writability with a pencil, and anti-blocking properties. Useful matting agents are those which are formed of a fine particulate material such as silicon dioxide, titanium oxide or polymethyl methacrylate. Other preferably used matting agents are: organic matting agents as described in British Pat. No. 1,055,713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448; and inorganic matting agents as described in West German Pat. No. 2,529,321, British Pat. Nos. 760,775, 1,260,772, and U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769020, 4,021,245, and 4,029,504. The matting agents preferably have an average particle size of 1–10 μm, more preferably 3–6 μm, with the range of 4–5 μm being most preferable.

A lubricant may be added in order to reduce the sliding friction of a light-sensitive material using the silver halide emulsion defined in accordance with the present invention. Preferable lubricants are described in many references such as French Pat. No. 2,180,465, British Pat. Nos. 955,061, 1,320,564, 1,320,757, Japanese Patent Application (OPI) No. 141623/1976, Research Disclosure No. 13969, U.S. Pat. Nos. 1,263,722, 2,588,765, 2,739,891, 3,018,178, 3,042,522, 3,080,317, 3,082,087, 3,121,060, 3,222,178, 3,295,979, 3,489,567, 3,516,832, 3,658,573, 3,679,411, and 3,870,521.

Antistatic agents may be used with a view to preventing static buildup on a light-sensitive material using the silver halide emulsion defined in accordance with the present invention. Antistatic agents may be incorporated in an antistatic layer formed on the side of a support where no emulsion layer is disposed; alternatively, they may be used in protective colloidal layers on the side of the support where emulsion layers are formed. Compounds that are preferably used as antistats are described in many references such as British Pat. No. 1,466,600, Research Disclosure Nos. 15840, 16258, 16630, and U.S. Pat. Nos. 2,327,828, 2,861,056, 3,206,312, 3,245,833, 3,428,451, 3,775,126, 3,963,498, 4,025,342, 4,025,463, 4,025,691, and 4,025,704.

Surfactants that are particularly preferable for use as antistatic agents are represented by the following general formulas (IV), (V), (VI) and/or (VII):

$$R_1'-A\text{-}(CH_2CH_2O)_{n1}-H \quad \text{(IV)}$$

(V)

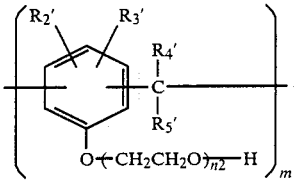

(VI)

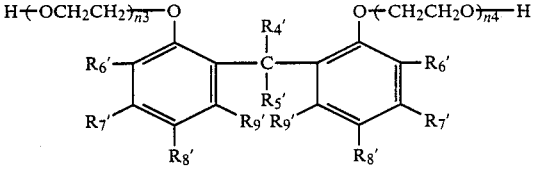

where $R_1'$ is a substituted or unsubstituted alkyl, alkenyl or aryl group having 1–30 carbon atoms; A' is —O—, —S—, —COO—, —N—$R_{10'}$, —CO—N—$R_{10'}$ or —$SO_2$N—$R_{10'}$ (where $R_{10'}$ is a hydrogen atom or a substituted or unsubstituted alkyl group); $R_2'$, $R_3'$, $R_7'$ and $R_9'$ signify independently a hydrogen atom, a substituted or unsubstituted alkyl group, an aryl group, an alkoxy group, a halogen atom, an acyl group, an amido group, a sulfonamido group, a carbamoyl group or a sulfamoyl group; $R_6'$ and $R_8'$ signify independently a substituted or unsubstited alkyl group, an aryl group, an alkoxy group, a halogen atom, an acyl group, an amido group, a sulfonamido group, a carbamoyl group or a sulfamoyl group, with the phenyl ring optionally having a bilaterally asymmetric substituent; $R_4'$ and $R_5'$ signify independently a hydrogen atom, a substituted or unsubstituted alkyl group or an aryl group, provided that $R_4'$ and $R_5'$, or $R_6'$ and $R_7'$, or $R_8'$ and $R_9'$ may be linked to each other to form a substituted or unsubstituted ring; $n_1$, $n_2$, $n_3$ and $n_4$ each represents the average degree of polymerization of ethylene oxide, which is within the range of 2–50; m represents the average degree of polymerization and ranges from 2 to 50;

$$Rf—A—(CH_2CH_2O)\ B—E \qquad (VII)$$

where Rf signifies an alkyl, alkenyl or aryl group having 1–30 carbon atoms, which group may be substituted either totally or partly by a fluorine atom; A' has the same meaning as defined for formula (IV); B is an alkenylene, alkylene or arylene group; E is a water-soluble group; and $n_5$ signifies a number of 0 to 50.

Specific examples of the compounds of formula (IV), (V), (VI) or (VII) are listed below.

Illustrative compounds of (IV):

1. $C_{11}H_{23}COO(CH_2CH_2O)_5H$
2. $C_8H_{17}O(CH_2CH_2O)_{13}H$
3. 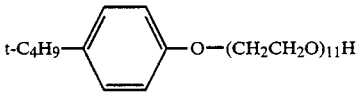

Illustrative compounds of (V):

4. 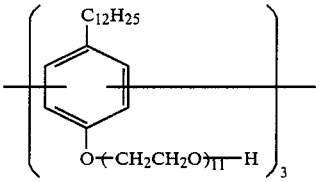
5. 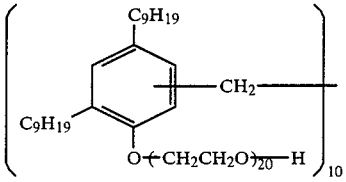

Illustrative compounds of (VI):

6. 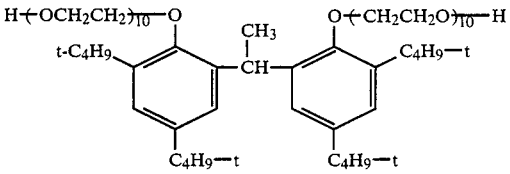

-continued

7. 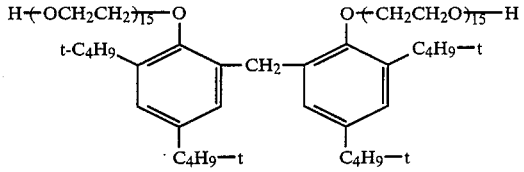
8. 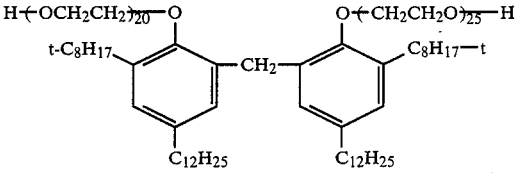
9. 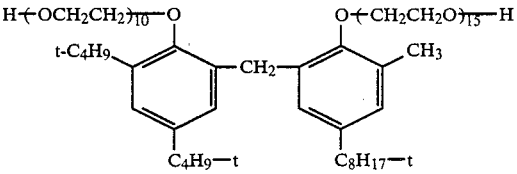
10. 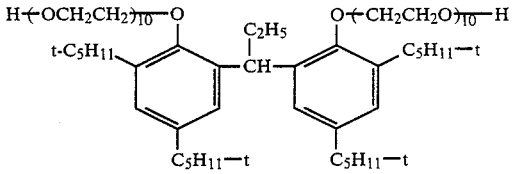

Illustrative compounds of (VII):

11. $C_7F_{15}CON(C_3H_7)CH_2CH_2SO_3Na$
12. $C_8F_{17}SO_2N(C_3H_7)(CH_2CH_2O)_6(CH_2)_4SO_3Na$
13. 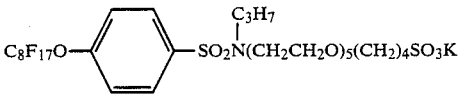
14. $C_8H_{17}SO_2N(C_3H_7)(CH_2CH_2O)_8H$ Fifty-two typical examples of fluorine-containing surfactants which are suitable for use in the practice of the present invention are listed below:

1. $F_3C—(CF_2)_2—COOH$
2. $H—(CF_2)_6—COOH$
3. $CF_3—(CF_2)_6—COONH_4$
4. $H—(CF_2)_{10}—COOH$
5. $F_3C—(CF_2)_7—SO_3K$
6. $H—(CF_2)_6—CH_2—OSO_3Na$
7. $H—(CF_2)_3—CH_2—OSO_3Na$
8. 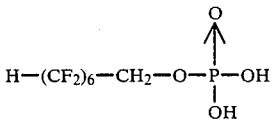

-continued
9.
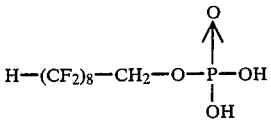
10.
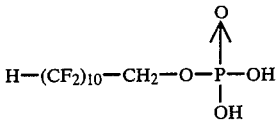
11.
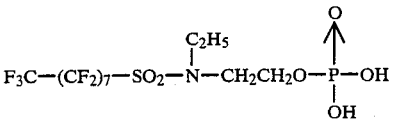
12.
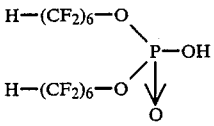
13.
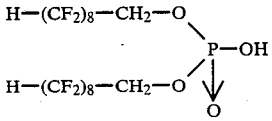
14.
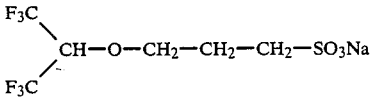
15. $H-(CF_2)_6-CH_2-O-CH_2-CH_2-CH_2-SO_3Na$
16. $H-(CF_2)_8-CH_2-O-CH_2-CH_2-CH_2-SO_3Na$
17. $H-(CF_2)_{10}-CH_2-O-CH_2-CH_2-CH_2-SO_3Na$
18. $F_3C-(CF_2)_6-CH_2-O-CH_2-CH_2-CH_2-SO_3Na$
19.
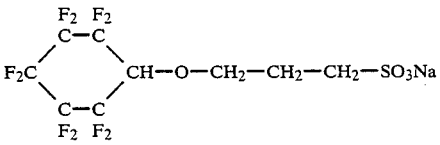
20.
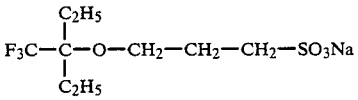
21. $F_3C-(CH_2)_2-COO-CH_2-CH_2-CH_2-SO_3Na$
22. $H-(CF_2)_{10}-COO-CH_2-CH_2-CH_2-SO_3Na$
23. $H-(CF_2)_6-CH_2-OCC-CH_2-CH_2-SO_3Na$
24.
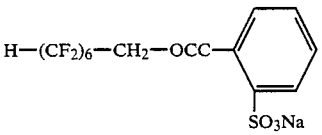
25.
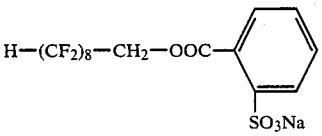
-continued
26.
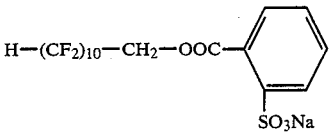
27.
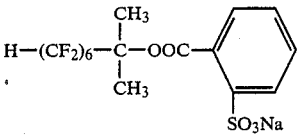
28.
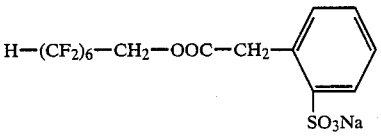
29.
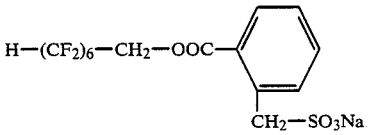
30. $C_{16}H_{33}-CH(SO_3Na)-COO-CH_2-CF_3$
31.
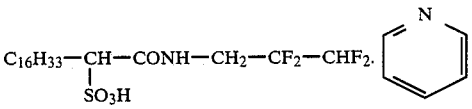
32. $C_{16}H_{33}-CH(SO_3Na)-CONH-CH_2-CF_2-CHF_2$
33.
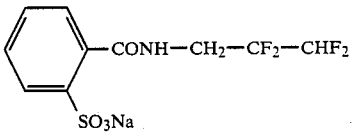
34. $F_3C-(CF_2)_2-COO(-CH_2-CH_2O)_7-CH_3$
35. $F_3C-(CF_2)_7-SO_2-N(C_2H_5)(-CH_2-CH_2O)_4H$
36. $F_3C-(CF_2)_2-CH_2O(-CH_2-CH_2O)_5H$
37.
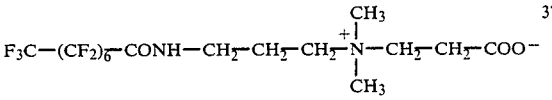
38. $H-(CF_2)_6-CONH-CH_2-CH_2-O-SO_3Na$
39.
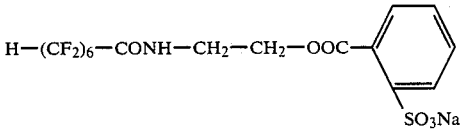
40. $F_3C-(CF_2)_7-SO_2-N(C_2H_5)-CH_2COOH$ -continued

41. $F_3C-(CF_2)_7-SO_2-N(C_2H_5)-CH_2-CH_2-O-SO_3H$

42. 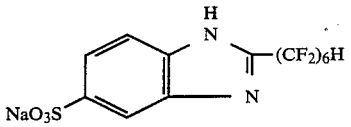

43. $NaO_3S-CH(CH-COOCH_2(CF_2CF_2)_3H)-COOCH_2(CF_2CF_2)_3H$

44. $H-(CF_2CF_2)_4-CH_2-O-(CH_2CH_2O)_{20}H$

45. $NaO_3S-CH(CH_2-COOC_2H_5)-COO(CH_2CH_2O)_2CH_2(CF_2CF_2)_3H$

46. $H-(CF_2CF_2)_3-CH_2OCH_2-CH(OH)O(CH_2CH_2O)_{22}H$

47. $F_{17}C_8SO_2NHCH_2CH_2CH_2-\overset{+}{N}(CH_3)_2-CH_2CH_2OHBr^-$

48. 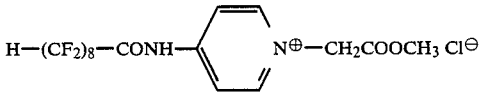

49. 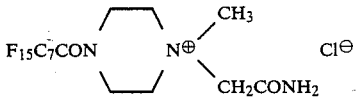

50. $F_{19}C_9-O-(CH_2CH_2O)_{10}-CH_2CH_2-OH$

51. 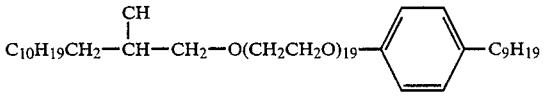

52. 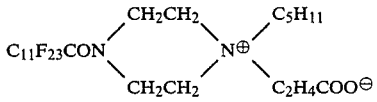

Photographic emulsion layers and/or other hydrophilic colloidal layers in a light-sensitive material using the silver halide emulsion defined in accordance with the present invention may contain a variety of surfactants for achieving various purposes, such as providing improved coating and slip properties, facilitating the preparation of an emulsified dispersion, preventing blocking, and providing improved photographic characteristics (e.g., accelerated development, film hardening, and sensitization).

Preferable anionic surfactants are those which contain an acidic group such as a carboxyl, sulfo, phospho, sulfate ester or phosphate ester group; illustrative examples include alkyl carboxylate salts, alkyl sulfonate salts, alkylbenzenesulfonate salts, alkylnaphthalenesulfonate salts, alkyl sulfate esters, alkyl phosphate esters, N-acyl-N-alkyltaurines, sulfosuccinate esters, sulfoalkyl polyoxyethylene alkylphenyl ethers, and polyoxyethylene alkyl phosphate esters.

Preferable. amphoteric surfactants include amino acids, aminoalkylsulfonic acids, aminoalkyl sulfate or phosphate esters, alkylbetaines, and amine oxides.

Preferable cationic surfactants include alkylamine salts, aliphatic or aromatic quaternary ammonium salts, pyridinium, imidazolium and other heterocyclic quaternary ammonium salts, and aliphatic or heterocyclic phosphonium or sulfonium salts.

Preferable nonionic surfactants include: saponin (steroid), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, and addition products of silicone with polyethylene oxide), glycidol derivatives (e.g., alkenylsuccinic acid polyglyceride and alkyl phenol polyglyceride), aliphatic acid esters of polyhydric alcohols, and alkyl esters of saccharides.

Colloidal silica may be used as a film quality improving agent. Various commercial products of colloidal silica having an average particle size of 10–20 mμ are available, such as Snow Tex C of Nissan Chemical Industries, Ltd., and Ludox AM of Du Pont. Colloidal silica is used in an amount of 0.01–100 wt %, preferably 0.1–100 wt %, more preferably 0.1–50 wt %, of gelatin.

A variety of supports may be employed for preparing a light-sensitive material using the silver halide emulsion defined in accordance with the present invention and they include: flexible reflective supports such as paper or synthetic paper laminated with α-olefin polymers (e.g., polyethylene, polypropylene, and ethylene/-butene copolymers); films formed of semi-synthetic or synthetic high-molecular weight compounds such as cellulose acetate, cellulose nitrate, polystyrene, polyvinyl chloride, polyethylene terephthalate, polycarbonate and polyamide; flexible supports having a reflective layer formed on these films; glass, metals and ceramics.

The support of the silver halide light-sensitive material used in the present invention may optionally be subjected to a suitable surface treatment such as corona discharging, irradiation with ultraviolet rays, or flame treatment. Thereafter, the necessary silver halide material is coated to the support either directly or indirectly with one or more undercoats being formed on the support so as to improve its surface characteristics, such as anti-blocking properties, antistatic properties, dimensional stability, wear resistance, hardness, anti-halation properties, frictional properties and/or other properties. Preferably, the support is subbed as described in Japanese Patent Application (OPI) Nos. 104913/ 1977, 18949/1984, 19940/1984, and 19941/1984.

In order to ensue efficient coating operations for the production of a photographic material using the silver halide emulsion defined in accordance with the present invention, a thickening agent may be employed. There are some additives like hardening agents that are so reactive as to form a gel before application of a coating solution containing it is started. Such additives are preferably mixed with the coating solution immediately before it is applied and this can be achieved by use of a static mixer or other suitable devices.

Preferable thickening agents are described in such prior patents as British Pat. No. 1,351,767, Japanese Patent Publication No. 12820/1970, and USP 2,956,883 and 3,767,410.

In preparing a light-sensitive material using the silver halide defined in accordance with the present invention, silver halide emulsion layers and other protective colloidal layers may be applied by the method described in Research Disclosure No. 17643, XV, A, and dried by the method described in XV, B of the same reference.

Particularly useful coating techniques are extrusion coating and curtain coating which are capable of simultaneous coating of two or more layers. The coating speed may be set to any value but speeds of 50 m/min or higher are preferable for the purpose of ensuring a high production rate.

The silver halide photographic material of the present invention may be exposed to electromagnetic waves within a spectral region in which the emulsion layers in the photographic material have sensitivity. Any known light sources can be used and they include daylight (sunshine), tungsten lamps, fluorescent lamps, mercury lamps, xenon arc lamps, carbon arc lamps, xenon flash lamps, flying spots on CRT, light from a variety of lasers, light from LEDs, and light emitted from phosphors excited by electron beams, X-rays, gamma-rays, or alpha-rays.

The exposure time is variable over a wide range; it may range from 1 millisecond to 1 second as is usable with cameras, or it may be shorter than 1 microsecond, for example, within the range of 100 nanoseconds to 1 microsecond which can be achieved with CRTs or xenon arc lamps; alternatively, exposure may last longer than 1 second. Exposure may be continuous or intermittent.

The silver halide photographic material of the present invention may be subjected to black-and-white development and subsequent processing, which consists of development, fixing and washing steps. The washing step is sometimes omitted if a stop treatment is effected after development, or if the fixing step is followed by stabilization. Development may be achieved with an alkali solution alone, with a developing agent or a precursor thereof being incorporated in the light-sensitive material. Development may also be conducted with a lith developer.

The black-and-white developer used in black-and-white development is either a common "first black-and-white developer" used in the processing of color photographic materials, or one which is commonly employed in the processing of black-and-white photographic materials. This black-and-white developer may contain a variety of additives that are commonly added to black-and-white developers.

Typical additives include: developing agents such as 1-phenyl-3-pyrazolidone, Methol and hydroquinone; preservatives such as sulfite salts; accelerators made of alkalis such as sodium hydroxide, sodium carbonate and potassium carbonate; inorganic or organic restrainers such as potassium bromide, 2-methyl benzimidazole, and methyl benzothiazole; water softening agents such as polyphosphoric acid salts; and trace amounts of iodides or mercapto compounds used to prevent excessive surface development.

Preferable developers are alkaline aqueous solutions which contain common black-and-white developing agents, used either alone or in combination, such as hydroquinone, alkyl hydroquinones (e.g., t-butyl hydroquinone, methyl hydroquinone, and dimethyl hydroquinone), catechol, pyrazole, chlorohydroquinone, dichlorohydroquinone, alkoxyhydroquinones (e.g., methoxy- or ethoxy-hydroquinone), aminophenols (e.g., N-methyl-p-aminophenol and 2,4-diaminophenol), ascorbic acids, N-methyl-p-aminophenol sulfate, pyrazolones (e.g., 4-aminopyrazolone), and 3-pyrazolidones (e.g., 1-phenyl-3-pyrazolidone, 1-phenyl-4,4-dimethyl-3-pyrazolidone, 1-phenyl-5-methyl-3-pyrazolidone, 1-phenyl-4-methyl-3-pyrazolidone, 1,5-diphenyl-3-pyrazolidone, 1-p-tolyl-3-pyrazolidone, 1-phenyl-2-acetyl-4,4-dimethyl-3pyrazolidone, 1-p-hydroxyphenyl-4,4-dimethyl-3-pyrazolidone, 1-(2-benzothiazolyl)-3-pyrazolidone, and 3-acetoxy-i-phenyl-3-pyrazolidone).

Combinations of hydroquinone and 3-pyrazolidones or aminophenols are particularly useful for carrying out rapid processing at high temperatures.

The developer that is preferably used in the present invention may contain hardening agents.

Dialdehyde-based hardening agents are preferably used and they include: β-methyl glutaraldehyde, glutaraldehyde, α-methylglutaraldehyde, maleic dialdehyde, succinic dialdehyde, methoxysuccinic dialdehyde, α,α-dimethyl glutaraldehyde, methyl maleic dialdehyde, methyl succinic dialdehyde, α-methyl-β-ethoxyglutaraldehyde, α-n-butoxyglutaraldehyde, α-ethyl-β-ethoxyglutaraldehyde, β-n-butoxyglutaraldehyde, α,α-dimethoxysuccinic dialdehyde, β-isopropoxysuccinic dialdehyde, α,α-diethyl succinic dialdehyde, and butyl maleic dialdehyde. These dialdehyde-based hardening agents are generally used in amounts of 1–20 g, preferably 3–5 g, per liter of the developing solution.

Other additives may be incorporated in the developing solution as required and they include: preservatives such as sulfite salts of alkali metals (e.g., sodium sulfite, potassium sulfite, and potassium metabisulfite); buffering agents (e.g., carbonate salts, boric acid, boric acid salts, and alkanolamine); alkali agents (e.g., hydroxides and carbonate salts); dissolving aids (e.g., polyethylene glycols and esters thereof); pH adjusting agents such as organic acids (e.g., acetic acid); sensitizers (e.g., quaternary ammonium salts); development accelerators; and surfactants.

The developing solution may further contain antifoggants (e.g., 5-nitroindazole, 5-nitro-benzimidazole, benzotriazoles such as 5-methyl-benzotriazole and 5-nitrobenzotriazole, thiazoles such as benzothiazole, tetrazoles such as 1-phenyl-5-mercapto-tetrazole, and the compounds described in British Pat. No. 1,269,268) or chelating agents (e.g., ethylenediaminetetraacetic acid, alkali metal salts thereof, polyphosphoric acid salts, and nitriloacetic acid salts).

The pH of the so prepared developing solution is adjusted to a value that is sufficient to achieve a desired density and contrast and a preferable range is from about 8 to 12, with the range of from about 9.0 to 10.5 being particularly preferable.

The temperature and time of development are correlated and are determined in consideration of the total processing time. For the purposes of the present invention, development may be carried out at between 30 and 49° C. for a period of 10–20 seconds.

The fixing solution is an aqueous solution containing a thiosulfate salt or a water-soluble aluminum compound. Desirably, the fixing solution has a pH of from about 3.8 to 5.0 (at 20° C.). The processing method of the present invention may include a stopping step after development. However, the stopping step is usually omitted from roller transport type automatic processors and the developing solution is carried over into the fixing solution so as to increase its pH. In consideration of this fact, it is desirable that the pH of the fixing solution is adjusted to be within the range of from about 3.8 to 4.6 (20° C.).

The fixing agent is selected from among thiosulfate salts such as ammonium thiosulfate and sodium thiosulfate, the former being particularly preferable from the viewpoint of fixing speed. The amount of fixing agent used is variable but generally within the range of from about 0.1 to 5 moles/L.

The water-soluble aluminum salt present in the fixing solution chiefly works as a hardening agent and may be selected from among the compounds which are commonly known as hardening agents to be incorporated in acidic hardening/fixing solution, such as aluminum chloride, aluminum sulfate and potassium alum. For the purposes of the present invention, fixing is preferably carried out at 20–35° C. for a period of 4–15 seconds.

According to the method of the present invention, the developed and fixed photographic material is washed with water and dried. Washing with water is performed in order to remove substantially all of the silver salts that have been dissolved as a result of fixing, and is preferably carried out at about 20–50° C. for a period of 5–12 seconds. Drying is performed at a temperature of about 40–100° C. While the length of the drying time is dependent on the ambient conditions, a period of from about 5 to 15 seconds is typically used.

There is no particular limitation on the type of automatic processor that is preferably used in the practice of the present invention and which is capable of completing all steps within a total period of 20–60 seconds, and a roller transport type or belt transport type developer may be employed, with the former type being preferable.

FIG. 1 shows an automatic processor that is preferably used in practicing the method of the present invention. This automatic processor is compact in size (no more than about 800 mm in each of height, width and depth) and still has the ability to process about 500 quater-plates (films of a size of 10 × 12 inches) per hour. The processor is also capable of containing two replenishing tanks of a capacity of about 25 liters with the respective dimensions of the processor not exceeding about 1,200 mm, 800 mm and 800 mm.

The automatic processor shown in FIG. 1 has the following construction. The machine is entirely enclosed with a light-tight housing 20. On the left side of the housing is provided a film inserting table 1 along which unprocessed light-sensitive materials are fed, and on the right side of the housing is disposed a film basket 2 for guiding the processed light-sensitive materials being discharged.

Figure 2:
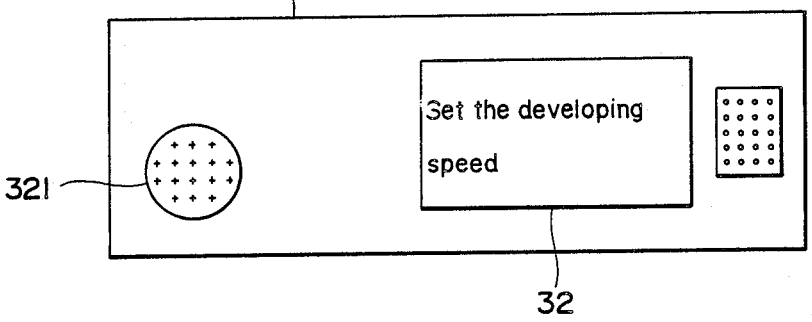
FIG. 2 is a front view of the operating panel on the developing machine of FIG. 1.

In the upper portion of the front side of the housing is disposed an operating panel 3 which is equipped with the necessary operating switches and indicators. By means of these switches, the machine is started or stopped, the processing temperature is set, and the setting of processing temperature or the occurrence of any trouble is shown on an interactive display 32 (not shown) on the operating panel (see FIG. 2). A speaker 321 may be provided for achieving interactive communication by voice. A receiver 31 intercepts information from a separately provided control box (not shown) and remote control from an operating room can be effected in order to ensure rapidity in an emergency.

The housing 20 contains a plurality of feed rollers 4 that are driven at constant speed between a film receiving section 1*a* at the end of the film inserting table 1 and a film takeup section 2*a* from which the processed light-sensitive materials are discharged into the film basket 2. The rollers 4 provide a serpentine path of film transport 5. A light-sensitive material to be processed is fed into the film receiving section 1*a* in the direction indicated by the one-long-and-one-short dashed arrow and is then guided along the transport 5 to be passed, in order, through adjacently disposed developer tank 6, fixing tank 7, washing tank 8, and drying zone 9. Therefore, the unprocessed light-sensitive material is processed photographically as it is fed from the film receiving section 1*a* and discharged from the film takeup section 2*a* in the direction indicated by the solid arrow 1'. The developer tank 6, fixing tank 7 and washing tank 8 are made into an integral unit to prevent fluid leakage. Each tank is provided with a level sensor (not shown) that detects the level of the processing solution in each tank such that the proper amount of solution will be maintained in each tank. Electrodes may be used in the level sensor; other types of level sensor may also be used and they include an ultrasonic wave sensor, a photosensor which detects the transmittance of light through the fluid between a light-emitting and a light-receiving units, and a non-contact type sensor. By controlling the level of processing solution in each tank, variation in processing time can be eliminated and controlled processing of the light-sensitive material is achieved. Variation in processing time can also occur if the feed rate is made different from one feed roller 4 to another because of variation in voltage or load and, in order to avoid this problem, an appropriate drive motor is selected. In addition, the appropriate processing time for specific type of light-sensitive material can be selected either by depressing a push-button switch for effecting speed change or by automatically identifying the light-sensitive material to be processed. Any selected speed is maintained constant for all feed rollers.

A film width detecting means (not shown) is provided at the film receiving section 1*a* so as to identify the width of the light-sensitive material to be processed and to output the detected information to a control unit which calculates the area of the light-sensitive material to provide a criterion for replenishing the processing fluids. The film width detecting means provided in the vicinity of the film receiving section 1*a* is usually connected to the control unit by an electric cord. If it is desirable to eliminate the possibility of transmitting erroneous information because of the electrical noise that may result from a load of large capacity, such as a heater, provided between the film width detecting means and the control unit, an optical fiber cable may be effectively used to connect the two components.

Each of the developer tank 6, fixing tank 7 and washing tank 8 is provided with a temperature control tank that is a molded part which is made integral with the associated processing tank. The shape of the temperature control tank may be so designed as to permit complete discharging of the processing fluid. The temperature control tank is equipped with a temperature sensor for detecting the temperature of processing fluid. A suitable temperature sensor is a thermistor, a platinum sensor or a silicon sensor. Information from the temperature sensor is fed into a temperature control unit which controls the temperature of each processing fluid to an appropriate level. The drying zone 9 is fed with information not only about temperature also about humidity such that a heater and a fan are controlled to ensure appropriate drying conditions including temperature, humidity and air flow. This control method may be employed for a variety of drying means. In FIG. 1, 91 denotes a squeeze section and 92 is a drying means section.

The fluids in the developer tank 6, fixing tank 7 and wash tank 8 are discharged through associated cocks 22 which are disposed on the wall of the housing 20 to provide for easy handling.

The automatic processor shown in FIG. 1 is connected to various associated apparatus such as a film feeder which supplies sheets of light-sensitive material one at a time. Interface between the automatic processor and any associated apparatus may be established by an optical fiber cable to avoid any external noise. A unitary system can be constructed by supplying power to one of the associated apparatus.

A microcomputer may be employed with the automatic processor to accomplish not only calculation of the necessary amount of processing fluids to be replenished but also control over temperature and the drive of feed rollers. Easy maintenance of the processor can be realized by using a hand-held computer for the purpose of checking the necessary data and associated input and drive systems.

The rollers 4 are preferably made of rubber such as silicone rubber or ethylene/propylene (e.g., EPDM) rubber.

The automatic processor described above ensures good film transport and image quality over a wide range of the surface roughness ($R_{max}$) of rollers from 0.1 to 100 μm. This affords a distinct advantage over the prior art system which requires $R_{max}$ = 1–15 μm for achieving good film transport and image quality (the surface roughness $R_{max}$ may be determined in accordance with JIS B 0601).

The automatic processor described above typically uses 1 to 8 rollers (e.g., rubber rollers) in the developing zone. This processor allows the hardness of rubber rollers to be varied by a degree of up to 30 without causing any substantial image deterioration. Therefore, no adverse effects will be produced even if rubber rollers having a hardness scale of 30 become harder to a scale of 60 as a result of prolonged use. With the prior art system, a change in image quality occurs if the hardness of rollers varies by a degree larger than about 10. On the other hand, the automatic developing machine used in the present invention can be operated without any trouble even if the hardness of rollers changes or rollers a certain distribution of hardness are employed. This increases the degree of freedom in roll design and a certain variation in the hardness distribution of rollers is allowed without causing any substantial problem (the hardness of rubbers may be determined in accordance with JIS K 6301).

The processor used in the present invention has the additional advantage that end-to-end distance between two films (having., the distance from the rear end of a previously inserted film and the front end of a subsequently inserted film) can be reduced to as short as 5–80 mm (conventionally, 40 mm is the shortest distance), and this provides for very rapid processing of films and the throughput can be increased by a maximum of 20%.

In addition, the processor permits the use of fewer rollers, for example, about 20 rollers fewer than those required in a prior art processor of the same capability (e.g., 85 rollers as compared with 110 rollers). On the other hand, the ratio of pinch rollers to the total number of rollers used can be increased to be within the range of 0.5–1.0 (conventionally about 0.45) and this allows for a reduction in the total processing time without sacrificing the image quality.

The necessary amount of replenishing solution can be reduced to lie within the range of 5–40 cc per quarto size sheet for the developing solution, and 10–70 cc for the fixing solution, without sacrificing the processability or image quality. Conventionally, the developing solution must be replenished with 33 cc (+10%, −0%) per quarto size sheet and the fixing solution with 63 cc (+10%, −0%) per quarto size sheet. The quantity of washing solution is also reduced from the conventionally required 1.5–5 liters/min to 0.5–3.0 liters/min without sacrificing the processability or image quality.

The automatic processor used in the present invention can be operated without a fixing filter and yet the occurrence of scum or soil can be reduced or entirely eliminated (conventionally, a filter is used in both development and fixing steps).

Satisfactory film drying can be accomplished with a drying air flow of 6–14 $m^3$/min and a heater capacity of 2.0–4.0 kW (at 200 volts). In the prior art system, the flow rate and heater capacity must be at least about 14 $m^3$/min and 3.5 kW, respectively.

The water content of a silver halide photographic material at the time when the washing step is completed is measured by the following procedures. A specimen is first given the necessary amount of exposure to provide a maximum density covering an area of 20 cm × 20 cm. The exposed specimen is then fed into an automatic processor KX- 500 of Konishiroku Photo Industry Co., Ltd. where it is developed with a developing solution (for its composition, see below) at 35° C. for 25.24 seconds, fixed with a fixing solution (for its composition, also see below) at 30° C. for 19.19 seconds, and washed with water (20° C.) for 12.87 seconds at a flow rate of 3 liters/min.

Compositions of developing and fixing solutions:

| | |
|---|---|
| Developing solution | |
| Potassium sulfite | 55.0 g |
| Hydroquinone | 25.0 g |
| 1-Phenyl-3-pyrazolidone | 1.2 g |
| Boric acid | 10.0 g |
| Sodium hydroxide | 21.0 g |
| Triethylne glycol | 17.5 g |
| 5-Nitrobenzoimidazole | 0.10 g |
| Glutaraldehyde bisulfite | 15.0 g |
| Glacial acetic acid | 16.0 g |
| Potassium bromide | 4.0 g |
| Triethylenetetramine tetraacetic acid | 2.5 g |
| Water | to make 1,000 ml |
| Fixing solution | |
| Ammonium thiosulfate | 130.9 g |
| Anhydrous sodium sulfite | 7.3 g |
| Boric acid | 7.0 g |
| Acetic acid (90 wt % aq. sol.) | 5.5 g |
| Sodium acetate trihydrate | 25.8 g |
| Aluminum sulfate $18H_2O$ | 14.6 g |
| Sulfuric acid (50 wt % aq. sol.) | 6.77 g |
| Water | to make 1,000 ml |

The washed specimen emerging from the squeeze rack (numeral reference 91 in FIG. 1) is withdrawn and its weight is measured within 60 seconds. The measured weight, $W_w$ (g), is recorded.

Then, the specimen is completely dried and left for at least one hour at 25° C. and at 55% r.h., followed by measurement of its weight. The measured weight, $W_d$ (g), is also recorded. The water content of the specimen at the time when the washing step was completed is calculated by the following equation:

$$\text{Water content } (g/m^2) = (W_w - W_d) \times (10{,}000\ cm^2/20\ cm \times 20\ cm)$$

The melting time of a light-sensitive material is measured by the following method: a specimen cut to a size of 1 cm × 2 cm is immersed in an aqueous solution of 1.5% sodium hydroxide that is held at 50° C. in the absence of agitation and the time required for the emulsion layer to dissolve out of the specimen into the aqueous sodium hydroxide solution is measured. The melting time is, therefore, defined as the time taken for the emulsion layer to dissolve out of the specimen after it has been immersed in an alkaline solution.

The following examples are provided for the purpose of further illustrating the present invention but are in no sense to be taken as limiting the scope of the invention.

EXAMPLE 1

A monodispersed silver iodobromide emulsion was prepared by the double-jet method at 60° C. with pAg and pH being controlled at 8.0 and 2.0, respectively. This emulsion was comprised of cubic grains having an average size of 0.20 μm and contained 2.0 mol % of silver iodide. Part of this emulsion was used as a core and subsequently allowed to grow in the following manner. To a solution containing the core grains and gelatin, an aqueous solution of ammoniacal silver nitrate and a solution of potassium iodide and potassium bromide were added by the double-jet method (40° C.; pAg = 9.0; pH = 9.0) to form a first coating layer containing 30 mol % of AgI. A solution of ammoniacal silver nitrate and a solution of potassium bromide were further added by the double-jet method at pAg = 9.0 and pH = 9.0 to form a second coating layer that was purely made of silver bromide. The resulting monodispersed silver iodobromide emulsion, E-1, was comprised of cubic grains having an average size of 0.57 μm and contained 2.0 mol % of silver iodide on the average.

To E-1, sensitizing dyes, A and B, shown below were added in the amounts also shown below, followed by addition of chloroaurate ($8 \times 10^{-7}$ moles per mole of AgX), sodium thiocyanate ($7 \times 10^{-6}$ moles per mole of AgX) and ammonium thiocyanate ($7 \times 10^{-4}$ moles per mole of AgX) to effect gold and sulfur sensitization in an optimum manner. The emulsion was with $2 \times 10^{-2}$ moles of 4-hydroxy-6-methyl-1,3,3a,7-tetrazaindene and adjusted to have a predetermined gelatin concentration (for its specific values, see Table 1.)

Sensitizing dye A

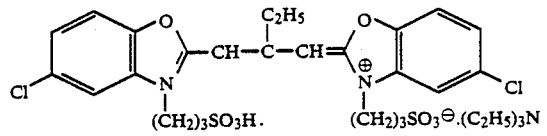

450 mg/mole of AgX

Sensitizing dye B

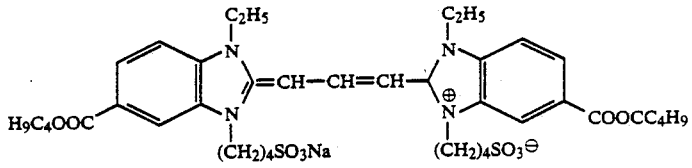

20 mg/mole of AgX

The following additives were further added to the emulsion: t-butyl catechol, 400 mg (per mole of silver halide); polyvinyl pyrrolidone (mol. wt. 10,000), 1.0 g; styrene/maleic acid copolymer, 2.5 g; trimethylolpropane, 10 g; diethylene glycol, 5 g; nitrophenyl-triphenyl phosponium choride, 50 mg; ammonium 1,3-dihydroxybenzene-4-sulfonate, 4 g; sodium 2-mercaptobenzimidazole-5-sulfonate, 15 mg;

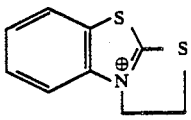

$CH_3SO_3^{\ominus}$, 70 mg;

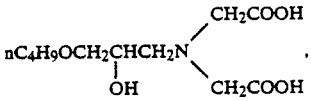

, 1 g;

and 1,1-dimethylol-1-bromo-1-nitromethane, 10 mg.

A coating solution for protective layer was prepared, with various additives being added in the amounts shown below and one or more hardening agents being added in the amounts indicated in Table 1 such as to provide a desired melting time (for its specific value, see Table 1).

| Additives to the protective layer (per gram of gelatin) | |
|---|---|
| 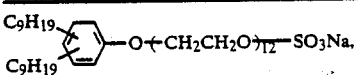 | 10 mg |
| 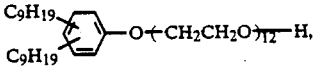 | 2 mg |
| 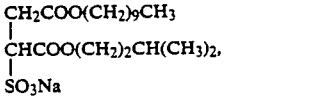 | 7 mg |
| 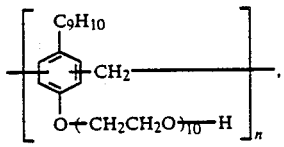 | 15 mg (mixture for n = 2–5) |

-continued

| Additives to the protective layer (per gram of gelatin) | |
|---|---|
| Matting agent formed of polymethyl methacrylate particles with an average size of 5 μm, | 7 mg |
| Colloidal silica with an average grain size of 0.013 μm, | 70 mg. |

The so prepared emulsion and protective layer (for its gelatin content, see Table 1) were applied simultaneously to both sides of a subbed polyester film base at a coating speed of 60 m/min, with the silver halide emulsion layer (viscosity, 11 cP; surface tension, 35 dyn/cm; thickness, 50 μm) being overlaid with the protective layer (viscosity, 11 cP; surface tension, 25 dyn/cm; thickness, 20 μm). Sample Nos. 1 to 86 were thus prepared and each of them had a silver content of 45 mg/dm$^2$.

The amounts of hardening agents in the respective samples were so adjusted that they would have the melting times indicated in Table 1. Measurement of melting time was conducted as follows: a specimen cut to a size of 1 cm × 2 cm was immersed in a solution of 1.5% sodium hydroxide held at 50° C. and the time required for the emulsion layer to dissolve out of the immersed specimen was measured.

Measurements of sensitivity and fog were conducted as follows: a specimen was held between two optical wedges with their density gradients being matched in a specularly symmetrical manner, and both sides of the specimen simultaneously received the same amount of exposure from a light source having a color temperature of 5,400° K.

The samples were then processed with a roller transport type automatic processor of the type shown in FIG. 1 which was capable of finishing the total processing in 45 seconds.

| | Temperature | Time |
|---|---|---|
| Film insertion | — | 1.2 sec |
| Development + transit | 35° C. | 14.6 sec |
| Fixing + transit | 33° C. | 8.2 sec |
| Washing + transit | 25° C. | 7.2 sec |
| Squeeze | 40° C. | 5.7 sec |
| Drying | 45° C. | 8.1 sec |
| Total | — | 45.0 sec |

While the automatic processor used in Example 1 had the basic construction shown in FIG. 1, it was designed to have the following special features: silicone rubber (hardness scale, 48) rollers were used in the transit areas, and EPDM (ethylene propylene rubber with a hardness scale of 46) rollers were used in the processing tanks; all rollers had a surface roughness ($R_{max}$) of 4 μm; six rollers were used in the developer tank and a total of 84 rollers were used in the machine; the number of nip rollers was 51 so that the ratio of nip rollers to the total number of rollers was about 0.61 (51/84); the amount of replenisher was 20 cc/quarto size sheet for developer, and 45 cc/quarto size sheet for fixing solution; the amount of washing solution was 1.5 liters/min; the air flow in the drying zone was 11 m$^3$/min; and the heater capacity was 3 kW (at 200 volts). The total processing time was 45 seconds.

The developer was prepared by optionally mixing developing solution (1) with a selected compound (IA) or (IIA) of the present invention in a predetermined amount (for the specific name and amount of added compound, see Table 1). The composition of fixing solution (1) is indicated below.

The relative sensitivity of each of the processed samples was determined from the amount of exposure at the point where its own characteristic curve intersected with the base-plus-fog-plus 1.0 axis.

| Compositions of developing solution and fixing solution | |
|---|---|
| Developing solution (1) | |
| Potassium sulfite | 55.0 g |
| Hydroquinone | 25.0 g |
| 1-Phenyl-3-pyrazolidone | 1.2 g |
| Boric acid | 10.0 g |
| Sodium hydroxide | 21.0 g |
| Triethylene glycol | 17.5 g |
| 5-Nitrobenzimidazole | 0.10 g |
| Glutaraldehyde bisulfite | 15.0 g |
| Glacial acetic acid | 16.0 g |
| Potassium bromide | 4.0 g |
| Triethylenetetramine tetraacetic acid | 2.5 g |
| Water | to make 1,000 ml |
| Fixing solution (1) | |
| Ammonium thiosulfate | 130.9 g |
| Anhydrous sodium sulfite | 7.3 g |
| Boric acid | 7.0 g |
| Acetic acid (90 wt % aq. sol.) | 5.5 g |
| Sodium acetate trihydrate | 25.8 g |
| Aluminum sulfate $18H_2O$ | 14.6 g |
| Sulfuric acid (50 wt % aq. sol.) | 6.77 g |
| Water | to make 1,000 ml |

Evaluation of granularity was conducted by visual inspection of the graininess of developed silver grains at density 1.0 in each of the samples processed with the roller transport type automatic processor under the conditions specified above. The results were rated by five scores, 1 (poor) to 5 (excellent). Ratings of 3 to 5 were acceptable but those of 1 and 2 were not acceptable for practical applications.

The drying property of each sample was evaluated by the following method: the hand and blocking properties (the degree of sticking to another sample) of a sample that had been passed through the drying zone after automatic processing for 45 seconds were subjected to overall evaluation and the results were rated by five scores, 1 (poor) to 5 (excellent). Ratings of 3 to 5 were acceptable but those of 1 and 2 were not acceptable for practical applications. Also, the water content was measured as mentioned above.

Each of the samples was also processed as in the conventional system by reducing the line speed by half so that the total processing time would be 90 seconds, and the resulting sensitivity was determined. The results are shown in Table 1.

TABLE 1

| Sample No. | Gelatin content ($g/m^2$ perside) emulsion layer | protective layer | total | Hardening agent type | amount (mg/g of getatin) | Development restrainer type | amount (g/l of developer) | Melting time (min) | Sensitivity by 90-sec processing | 45-sec processing sensitivity | fog | Granularity | Drying property | Water content on both sides ($g/m^2$) | Remarks |
|---|---|---|---|---|---|---|---|---|---|---|---|---|---|---|---|
| 1 | 2.45 | 1.15 | 3.60 | ① | 7.5 | — | — | 4 | 100 | 80 | 0.05 | 3 | 1 | 26.1 | X |
| 2 | 2.45 | 1.15 | 3.60 | ① | 24 | — | — | 20 | 90 | 70 | 0.05 | 4 | 3 | 15.0 | O |
| 3 | 2.45 | 1.15 | 3.60 | ① | 89 | — | — | 70 | 60 | 30 | 0.05 | 5 | 4 | 9.8 | X |
| 4 | 2.45 | 1.15 | 3.60 | ① | 7.5 | I-1 | 0.14 | 4 | 95 | 60 | 0.05 | 3 | 1 | 26.1 | X |
| 5 | 2.45 | 1.15 | 3.60 | ① | 24 | I-1 | 0.14 | 20 | 85 | 50 | 0.05 | 4 | 3 | 15.0 | O |
| 6 | 2.45 | 1.15 | 3.60 | ① | 89 | I-1 | 0.14 | 70 | 50 | 10 | 0.05 | 5 | 4 | 9.8 | X |
| 7 | 2.45 | 1.15 | 3.60 | ① | 7.5 | II-11 | 0.08 | 4 | 95 | 60 | 0.05 | 3 | 1 | 26.1 | X |
| 8 | 2.45 | 1.15 | 3.60 | ① | 24 | II-11 | 0.08 | 20 | 85 | 50 | 0.05 | 4 | 3 | 15.0 | O |
| 9 | 2.45 | 1.15 | 3.60 | ① | 89 | II-11 | 0.08 | 70 | 50 | 10 | 0.05 | 5 | 4 | 9.8 | X |
| 10 | 2.25 | 1.15 | 3.40 | ② | 5 | — | — | 4 | 150 | 130 | 0.06 | 2 | 2 | 25.0 | X |
| 11 | 2.25 | 1.15 | 3.40 | ② | 9.4 | — | — | 9 | 145 | 125 | 0.05 | 3 | 3 | 19.1 | O |
| 12 | 2.25 | 1.15 | 3.40 | ② | 16.8 | — | — | 20 | 140 | 120 | 0.05 | 3 | 3 | 14.7 | O |
| 13 | 2.25 | 1.15 | 3.40 | ② | 33.5 | — | — | 38 | 130 | 110 | 0.05 | 4 | 4 | 11.5 | O |
| 14 | 2.25 | 1.15 | 3.40 | ② | 62.8 | — | — | 65 | 105 | 75 | 0.05 | 4 | 4 | 9.7 | X |
| 15 | 2.25 | 1.15 | 3.40 | ② | 5 | I-1 | 0.14 | 4 | 140 | 120 | 0.05 | 2 | 2 | 25.0 | X |
| 16 | 2.25 | 1.15 | 3.40 | ② | 9.4 | I-1 | 0.14 | 9 | 135 | 115 | 0.03 | 3 | 3 | 19.1 | O |
| 17 | 2.25 | 1.15 | 3.40 | ② | 16.8 | I-1 | 0.14 | 20 | 130 | 110 | 0.03 | 4 | 3 | 14.7 | O |
| 18 | 2.25 | 1.15 | 3.40 | ② | 33.5 | I-1 | 0.14 | 38 | 120 | 100 | 0.03 | 4 | 4 | 11.5 | O |
| 19 | 2.25 | 1.15 | 3.40 | ② | 62.8 | I-1 | 0.14 | 65 | 95 | 65 | 0.03 | 4 | 4 | 9.7 | X |
| 20 | 2.25 | 1.15 | 3.40 | ② | 5 | II-11 | 0.08 | 4 | 140 | 120 | 0.05 | 2 | 2 | 25.0 | X |
| 21 | 2.25 | 1.15 | 3.40 | ② | 9.4 | II-11 | 0.08 | 9 | 136 | 116 | 0.03 | 3 | 3 | 19.1 | O |
| 22 | 2.25 | 1.15 | 3.40 | ② | 16.8 | II-11 | 0.08 | 20 | 131 | 111 | 0.03 | 4 | 3 | 14.7 | O |
| 23 | 2.25 | 1.15 | 3.40 | ② | 33.5 | II-11 | 0.08 | 38 | 120 | 102 | 0.03 | 4 | 4 | 11.5 | O |
| 24 | 2.25 | 1.15 | 3.40 | ② | 62.8 | II-11 | 0.08 | 65 | 95 | 64 | 0.03 | 4 | 4 | 9.7 | X |
| 25 | 1.85 | 1.15 | 3.00 | ① + ② (equimolar) | 5.5 | — | — | 4 | 155 | 135 | 0.07 | 2 | 2 | 24.2 | X |
| 26 | 1.85 | 1.15 | 3.00 | ① + ② (equimolar) | 9.8 | — | — | 9 | 150 | 130 | 0.06 | 3 | 3 | 18.5 | O |
| 27 | 1.85 | 1.15 | 3.00 | ① + ② (equimolar) | 17.5 | — | — | 20 | 145 | 125 | 0.06 | 3 | 4 | 14.0 | O |
| 28 | 1.85 | 1.15 | 3.00 | ① + ② (equimolar) | 35 | — | — | 38 | 136 | 115 | 0.06 | 4 | 4 | 11.0 | O |
| 29 | 1.85 | 1.15 | 3.00 | ① + ② (equimolar) | 65 | — | — | 63 | 109 | 80 | 0.06 | 4 | 4 | 9.7 | X |
| 30 | 1.85 | 1.15 | 3.00 | ① + ② (equimolar) | 5.5 | I-1 | 0.14 | 4 | 145 | 125 | 0.06 | 2 | 2 | 24.2 | X |
| 31 | 1.85 | 1.15 | 3.00 | ① + ② (equimolar) | 9.8 | I-1 | 0.14 | 9 | 141 | 122 | 0.04 | 3 | 3 | 18.5 | O |
| 32 | 1.85 | 1.15 | 3.00 | ① + ② (equimolar) | 17.5 | I-1 | 0.14 | 20 | 136 | 117 | 0.04 | 4 | 4 | 14.0 | O |
| 33 | 1.85 | 1.15 | 3.00 | ① + ② (equimolar) | 35 | I-1 | 0.14 | 38 | 128 | 108 | 0.04 | 4 | 4 | 11.0 | O |
| 34 | 1.85 | 1.15 | 3.00 | ① + ② (equimolar) | 65 | I-1 | 0.14 | 63 | 98 | 70 | 0.04 | 4 | 4 | 9.7 | X |
| 35 | 1.85 | 1.15 | 3.00 | ① + ② (equimolar) | 5.5 | II-11 | 0.08 | 4 | 145 | 125 | 0.06 | 2 | 2 | 24.2 | X |
| 36 | 1.85 | 1.15 | 3.00 | ① + ② (equimolar) | 9.8 | II-11 | 0.08 | 9 | 140 | 121 | 0.04 | 3 | 3 | 18.5 | O |
| 37 | 1.85 | 1.15 | 3.00 | ① + ② (equimolar) | 17.5 | II-11 | 0.08 | 20 | 136 | 116 | 0.04 | 4 | 4 | 14.0 | O |

TABLE 1-continued

| Sample No. | Gelatin content ($g/m^2$ perside) emulsion layer | protective layer | total | Hardening agent type | amount (mg/g of getatin) | Development restrainer type | amount (g/l of developer) | Melting time (min) | Sensitivity by 90-sec processing | 45-sec processing sensitivity | fog | Granularity | Drying property | Water content on both sides ($g/m^2$) | Remarks |
|---|---|---|---|---|---|---|---|---|---|---|---|---|---|---|---|
| 38 | 1.85 | 1.15 | 3.00 | ① + ② (equimolar) | 35 | II-11 | 0.08 | 38 | 130 | 109 | 0.04 | 4 | 4 | 11.0 | O |
| 39 | 1.85 | 1.15 | 3.00 | ① + ② (equimolar) | 65 | II-11 | 0.08 | 63 | 99 | 70 | 0.04 | 4 | 4 | 9.7 | X |
| 40 | 1.65 | 1.10 | 2.75 | ① + ② (equimolar) | 5 | — | — | 4 | 158 | 140 | 0.07 | 2 | 3 | 23.5 | X |
| 41 | 1.65 | 1.10 | 2.75 | ① + ② (equimolar) | 9 | — | — | 9 | 153 | 135 | 0.06 | 3 | 4 | 18.0 | O |
| 42 | 1.65 | 1.10 | 2.75 | ① + ② (equimolar) | 16 | — | — | 20 | 143 | 125 | 0.06 | 3 | 4 | 13.2 | O |
| 43 | 1.65 | 1.10 | 2.75 | ① + ② (equimolar) | 32 | — | — | 38 | 129 | 120 | 0.06 | 3 | 5 | 10.7 | O |
| 44 | 1.65 | 1.10 | 2.75 | ① + ② (equimolar) | 60 | — | — | 58 | 112 | 85 | 0.06 | 4 | 5 | 9.7 | X |
| 45 | 1.65 | 1.10 | 2.75 | ① + ② (equimolar) | 5 | I-1 | 0.14 | 4 | 148 | 130 | 0.06 | 2 | 3 | 23.5 | X |
| 46 | 1.65 | 1.10 | 2.75 | ① + ② (equimolar) | 9 | I-1 | 0.14 | 9 | 145 | 127 | 0.04 | 3 | 4 | 18.0 | O |
| 47 | 1.65 | 1.10 | 2.75 | ① + ② (equimolar) | 16 | I-1 | 0.14 | 20 | 135 | 118 | 0.04 | 4 | 4 | 13.2 | O |
| 48 | 1.65 | 1.10 | 2.75 | ① + ② (equimolar) | 32 | I-1 | 0.14 | 38 | 127 | 108 | 0.04 | 4 | 5 | 10.7 | O |
| 49 | 1.65 | 1.10 | 2.75 | ① + ② (equimolar) | 60 | I-1 | 0.14 | 58 | 103 | 75 | 0.04 | 4 | 5 | 9.7 | X |
| 50 | 1.65 | 1.10 | 2.75 | ① + ② (equimolar) | 5 | II-11 | 0.08 | 4 | 147 | 130 | 0.06 | 2 | 3 | 23.5 | X |
| 51 | 1.65 | 1.10 | 2.75 | ① + ② (equimolar) | 9 | II-11 | 0.08 | 9 | 144 | 127 | 0.04 | 3 | 4 | 18.0 | O |
| 52 | 1.65 | 1.10 | 2.75 | ① + ② (equimolar) | 16 | II-11 | 0.08 | 20 | 134 | 117 | 0.04 | 4 | 4 | 13.2 | O |
| 53 | 1.65 | 1.10 | 2.75 | ① + ② (equimolar) | 32 | II-11 | 0.08 | 38 | 127 | 107 | 0.04 | 4 | 5 | 10.7 | O |
| 54 | 1.65 | 1.10 | 2.75 | ① + ② (equimolar) | 60 | II-11 | 0.08 | 58 | 102 | 75 | 0.04 | 4 | 5 | 9.7 | X |
| 55 | 1.30 | 1.10 | 2.40 | ① + ② (equimolar) | 4.4 | — | — | 4 | 160 | 145 | 0.08 | 2 | 4 | 23.0 | X |
| 56 | 1.30 | 1.10 | 2.40 | ① + ② (equimolar) | 14 | — | — | 20 | 145 | 130 | 0.06 | 3 | 5 | 12.6 | O |
| 57 | 1.30 | 1.10 | 2.40 | ① + ② (equimolar) | 52 | — | — | 58 | 115 | 90 | 0.06 | 4 | 5 | 9.6 | X |
| 58 | 1.30 | 1.10 | 2.40 | ① + ② (equimolar) | 4.4 | I-1 | 0.14 | 4 | 148 | 133 | 0.07 | 2 | 4 | 23.0 | X |
| 59 | 1.30 | 1.10 | 2.40 | ① + ② (equimolar) | 14 | I-1 | 0.14 | 20 | 138 | 123 | 0.04 | 4 | 5 | 12.6 | O |
| 60 | 1.30 | 1.10 | 2.40 | ① + ② (equimolar) | 52 | I-1 | 0.14 | 58 | 98 | 82 | 0.04 | 4 | 5 | 9.6 | X |
| 61 | 1.30 | 1.10 | 2.40 | ① + ② (equimolar) | 4.4 | II-11 | 0.08 | 4 | 148 | 132 | 0.07 | 2 | 4 | 23.0 | X |
| 62 | 1.30 | 1.10 | 2.40 | ① + ② (equimolar) | 14 | II-11 | 0.08 | 20 | 137 | 122 | 0.04 | 4 | 5 | 12.6 | O |

TABLE 1-continued

| Sample No. | Gelatin content ($g/m^2$ perside) emulsion layer | protective layer | total | Hardening agent type | amount (mg/g of getatin) | Development restrainer type | amount (g/l of developer) | Melting time (min) | Sensitivity by 90-sec processing | 45-sec processing sensitivity | fog | Granularity | Drying property | Water content on both sides ($g/m^2$) | Remarks |
|---|---|---|---|---|---|---|---|---|---|---|---|---|---|---|---|
| 63 | 1.30 | 1.10 | 2.40 | ① + ② (equimolar) | 52 | II-11 | 0.08 | 58 | 98 | 83 | 0.04 | 4 | 5 | 9.6 | X |
| 64 | 1.00 | 1.10 | 2.10 | ⑫ | 12 | — | — | 4 | 162 | 150 | 0.08 | 1 | 4 | 22.0 | X |
| 65 | 1.00 | 1.10 | 2.10 | ⑫ | 19 | — | — | 20 | 147 | 135 | 0.06 | 3 | 5 | 11.8 | O |
| 66 | 1.00 | 1.10 | 2.10 | ⑫ | 145 | — | — | 58 | 118 | 95 | 0.06 | 3 | 5 | 9.5 | X |
| 67 | 1.00 | 1.10 | 2.10 | ⑫ | 12 | I-1 | 0.14 | 4 | 147 | 135 | 0.07 | 1 | 4 | 22.0 | X |
| 68 | 1.00 | 1.10 | 2.10 | ⑫ | 39 | I-1 | 0.14 | 20 | 141 | 130 | 0.05 | 3 | 5 | 11.8 | O |
| 69 | 1.00 | 1.10 | 2.10 | ⑫ | 145 | I-1 | 0.14 | 58 | 112 | 85 | 0.05 | 3 | 5 | 9.5 | X |
| 70 | 1.00 | 1.10 | 2.10 | ⑫ | 12 | II-11 | 0.08 | 4 | 147 | 136 | 0.07 | 1 | 4 | 22.0 | X |
| 71 | 1.00 | 1.10 | 2.10 | ⑫ | 39 | II-11 | 0.08 | 20 | 142 | 130 | 0.05 | 3 | 5 | 11.8 | O |
| 72 | 1.00 | 1.10 | 2.10 | ⑫ | 145 | II-11 | 0.08 | 58 | 111 | 85 | 0.05 | 3 | 5 | 9.5 | X |
| 73 | 0.90 | 1.00 | 1.90 | ⑯ | 13.5 | — | — | 4 | 165 | 155 | 0.09 | 1 | 4 | 20.8 | X |
| 74 | 0.90 | 1.00 | 1.90 | ⑯ | 43 | — | — | 20 | 150 | 140 | 0.07 | 1 | 5 | 11.3 | O |
| 75 | 0.90 | 1.00 | 1.90 | ⑯ | 162 | — | — | 58 | 120 | 100 | 0.07 | 2 | 5 | 9.4 | X |
| 76 | 0.90 | 1.00 | 1.90 | ⑯ | 13.5 | I-1 | 0.14 | 4 | 155 | 138 | 0.08 | 1 | 4 | 20.8 | X |
| 77 | 0.90 | 1.00 | 1.90 | ⑯ | 43 | I-1 | 0.14 | 20 | 143 | 133 | 0.05 | 2 | 5 | 11.3 | O |
| 78 | 0.90 | 1.00 | 1.90 | ⑯ | 162 | I-1 | 0.14 | 58 | 117 | 97 | 0.05 | 2 | 5 | 9.4 | X |
| 79 | 0.90 | 1.00 | 1.90 | ⑯ | 13.5 | II-11 | 0.08 | 4 | 155 | 137 | 0.08 | 1 | 4 | 20.8 | X |
| 80 | 0.90 | 1.00 | 1.90 | ⑯ | 43 | II-11 | 0.08 | 20 | 142 | 133 | 0.05 | 2 | 5 | 11.3 | O |
| 81 | 0.90 | 1.00 | 1.90 | ⑯ | 162 | II-11 | 0.08 | 58 | 118 | 97 | 0.05 | 2 | 5 | 9.4 | X |
| 82 | 1.65 | 1.10 | 2.75 | ① + ② (equimolar) | 5 | I-1 | 0.25 | 4 | 138 | 120 | 0.06 | 2 | 3 | 23.5 | X |
| 83 | 1.65 | 1.10 | 2.75 | ① + ② (equimolar) | 9 | I-1 | 0.25 | 9 | 136 | 118 | 0.03 | 4 | 4 | 18.0 | O |
| 84 | 1.65 | 1.10 | 2.75 | ① + ② (equimolar) | 16 | I-1 | 0.25 | 20 | 130 | 112 | 0.03 | 5 | 4 | 13.2 | O |
| 85 | 1.65 | 1.10 | 2.75 | ① + ② (equimolar) | 32 | I-1 | 0.25 | 38 | 124 | 106 | 0.03 | 5 | 5 | 10.7 | O |
| 86 | 1.65 | 1.10 | 2.75 | ① + ② (equimolar) | 60 | I-1 | 0.25 | 58 | 93 | 65 | 0.03 | 5 | 5 | 9.7 | X |

O: within the scope of the present invention; X: outside the scope of the invention (the same definition applies to Table 1 and Table 2)

As is clear from Table 1, the samples prepared in accordance with the present invention had superior overall ratings in terms of sensitivity, fog, granularity and drying property and, hence, were adaptive to very rapid processing. In comparison with sample No. 1 or 2 that was processed by the conventional system (90-sec processing), the samples of the present invention achieved high sensitivity even when they were processed for only 45 seconds. This means that the processing method of the present invention is twice as efficient as the conventional system.

EXAMPLE 2

A polydispersed emulsion, E-2, was prepared by the normal precipitation which was carried out in the following manner.

Four solutions were first prepared:

| | | |
|---|---|---|
| Solution A: | silver nitrate | 100 g |
| | ammonia (28% aq. sol.) | 78 cc |
| | water | to make 240 cc |
| Solution B: | ossein gelatin | 8 g |
| | potassium bromide | 80 g |
| | potassium iodide | 1.3 g |
| | water | to make 550 cc |
| Solution C: | aqueous ammonia | 6 cc |
| | glacial acetic acid | 10 cc |
| | water | 34 cc |
| Solution D: | glacial acetic acid | 226 cc |
| | water | to make 400 cc. |

Solutions B and C were charged into a reactor for emulsion preparation andagitated with a propeller stirrer at a speed of 300 rpm so as to maintain a reaction temperature of 45° C. Solution A was divided into two portions having different volumes, one being twice as much as the other. The smaller portion (100 ml) was charged into the mixture of solutions B and C over a period of 1 minute, followed by stirring for 5 minutes. Thereafter, the remaining larger portion (200 ml) was charged over a period of 2 minutes and stirring was conducted for an additional 15 minutes. To the resulting mixture, solution D was added and the pH of the mixture in the reactor was adjusted to 6 so as to quench the reaction. By these procedures, a polydispersed emulsion E-2 was produced. It contained 2.0 mol % of silver iodide and was comprised of grains havig an average size of 0.58 μm.

An emulsion, E-3, composed of tabular grains was prepared by the following procedures. To a solution (70° C.) containing 12 g of gelatin and 0.3 g of potassium bromide in 720 ml of water, two solutions, one containing 36 g of silver nitrate in 240 ml of water and the other containing 25.4 g of potassium bromide in 240 ml of water, were simultaneously added over a period of 30 seconds, and the mixture was subjected to Ostwald ripening for 5 minutes so as to prepare an emulsion (A) composed of tabular silver bromide grains as seed crystals To part of emulsion (A), an aqueous solution of potassium bromide was added and the pBr was adjusted to 0.8. After addition of potassium iodide (0.3 g), the remainder of emulsion (A) was slowly added as a supply-source emulsion so as to prepare an emulsion, E-3, composed of tabular silver iodobromide grains.

The so prepared tabular silver halide grains had an average size of 1.21 μm, an average diameter-to-thickness ratio of 11.5, with at least 95% of the total grains being taken by those having diameter-to-thickness ratios of 10 and more.

Excess water-soluble salts were removed from each of emulsions E-2 and E-3 by flocculation washing. To each of the so washed emulsions, 240 mg/mol AgX of a sensitizing dye No. 43, and gold thiocyanate/sodium thiosulfate were added to effect gold and sulfur sensitization in an optimum manner. Thereafter, each of the emulsions was stabilized with 4-hydroxy6-methyl-1,3,3a,7-tetrazaindene and the gelatin concentration was adjusted to provide a predetermined gelatin content (for its sepecific values, see Table 2). Besides the additives used in Example 1, 50 mg/mol AgX of thallium nitrate was added to each of the so prepared emulsions.

A coating solution for protective layer was prepared, with 20 mg of $$C_9F_{19}CH_2\overset{\overset{\displaystyle OH}{|}}{C}HCH_2O\leftarrow CH_2CH_2O\rightarrow_{20}CH_3$$

being added per mol of coated gelatin besides the additives used in Example 1. A combination of hardening agents was also added to provide a predetermined melting time (for its specific values, see Table 2). The so prepared coating solution for protective layer was applied to a photographic base together with emulsions E-2 and E-3. The performance of the so prepared samples was evaluated as in Example 1 and the results are shown in Table 2.

TABLE 2

| Sample No. | Emulsion No. | Gelatin content($g/m^2$ perside) emulsion layer | protective layer | total | Hardening agent type | amount (mg/g of getatin) | Development restrainer type | amount (g/l of developer) | Melting time (min) | Sensitivity by 90-sec processing | 45-sec processing sensitivity | fog | Granularity | Drying property | Water content on both sides ($g/m^2$) | Remarks |
|---|---|---|---|---|---|---|---|---|---|---|---|---|---|---|---|---|
| 87 | E-3 | 2.45 | 1.15 | 3.60 | ① + ② (equimolar) | 8.0 | — | — | 4 | 100 | 80 | 0.05 | 3 | 1 | 26.1 | X |
| 88 | E-3 | 2.45 | 1.15 | 3.60 | ① + ② (equimolar) | 25.7 | — | — | 20 | 90 | 70 | 0.05 | 4 | 3 | 15.0 | O |
| 89 | E-3 | 2.45 | 1.15 | 3.60 | ① + ② (equimolar) | 95.0 | — | — | 70 | 70 | 40 | 0.05 | 5 | 3 | 9.8 | X |
| 90 | E-3 | 2.45 | 1.15 | 3.60 | ① + ② (equimolar) | 25.7 | I-8 | 0.20 | 20 | 85 | 50 | 0.05 | 4 | 3 | 15.0 | O |
| 91 | E-3 | 2.45 | 1.15 | 3.60 | ① + ② (equimolar) | 25.7 | II-2 | 0.10 | 20 | 85 | 50 | 0.05 | 4 | 3 | 15.0 | O |
| 92 | E-3 | 1.65 | 1.10 | 2.75 | ① + ② (equimolar) | 5.0 | — | — | 4 | 160 | 140 | 0.07 | 2 | 3 | 23.5 | X |
| 93 | E-3 | 1.65 | 1.10 | 2.75 | ① + ② (equimolar) | 9.0 | — | — | 9 | 150 | 135 | 0.06 | 3 | 4 | 18.0 | O |
| 94 | E-3 | 1.65 | 1.10 | 2.75 | ① + ② (equimolar) | 16.0 | — | — | 20 | 140 | 125 | 0.06 | 3 | 4 | 13.2 | O |
| 95 | E-3 | 1.65 | 1.10 | 2.75 | ① + ② (equimolar) | 32.0 | — | — | 38 | 130 | 120 | 0.06 | 3 | 5 | 10.7 | O |
| 96 | E-3 | 1.65 | 1.10 | 2.75 | ① + ② (equimolar) | 60.0 | — | — | 58 | 110 | 85 | 0.06 | 4 | 5 | 9.7 | X |
| 97 | E-3 | 1.65 | 1.10 | 2.75 | ① + ② (equimolar) | 5.0 | I-8 | 0.20 | 4 | 145 | 130 | 0.06 | 2 | 3 | 23.5 | X |
| 98 | E-3 | 1.65 | 1.10 | 2.75 | ① + ② (equimolar) | 16.0 | I-8 | 0.20 | 20 | 135 | 125 | 0.04 | 4 | 4 | 13.2 | O |
| 99 | E-3 | 1.65 | 1.10 | 2.75 | ① + ② (equimolar) | 60.0 | I-8 | 0.20 | 58 | 105 | 80 | 0.04 | 4 | 5 | 9.7 | X |
| 100 | E-3 | 1.65 | 1.10 | 2.75 | ① + ② (equimolar) | 5.0 | II-2 | 0.10 | 4 | 145 | 83 | 0.06 | 2 | 3 | 23.5 | X |
| 101 | E-3 | 1.65 | 1.10 | 2.75 | ① + ② (equimolar) | 16.0 | II-2 | 0.10 | 20 | 135 | 130 | 0.04 | 4 | 4 | 13.2 | O |
| 102 | E-3 | 1.65 | 1.10 | 2.75 | ① + ② (equimolar) | 60.0 | II-2 | 0.10 | 58 | 105 | 77 | 0.04 | 4 | 5 | 9.7 | X |
| 103 | E-3 | 0.90 | 1.00 | 1.90 | ① + ② (equimolar) | 3.5 | — | — | 4 | 165 | 155 | 0.09 | 1 | 4 | 20.8 | X |
| 104 | E-3 | 0.90 | 1.00 | 1.90 | ① + ② (equimolar) | 11.1 | — | — | 20 | 148 | 135 | 0.07 | 2 | 5 | 11.3 | O |
| 105 | E-3 | 0.90 | 1.00 | 1.90 | ① + ② (equimolar) | 41.5 | — | — | 58 | 118 | 100 | 0.07 | 2 | 5 | 9.4 | X |
| 106 | E-3 | 0.90 | 1.00 | 1.90 | ① + ② (equimolar) | 11.1 | I-8 | 0.20 | 20 | 140 | 120 | 0.06 | 2 | 5 | 11.3 | O |
| 107 | E-3 | 0.90 | 1.00 | 1.90 | ① + ② (equimolar) | 11.1 | II-2 | 0.10 | 20 | 140 | 118 | 0.06 | 2 | 5 | 11.3 | O |
| 108 | E-2 | 2.45 | 1.15 | 3.60 | ① + ② (equimolar) | 25.7 | — | — | 20 | 90 | 65 | 0.05 | 3 | 3 | 15.0 | O |
| 109 | E-2 | 2.45 | 1.15 | 3.60 | ① + ② (equimolar) | 25.7 | I-8 | 0.20 | 20 | 80 | 40 | 0.05 | 3 | 3 | 15.0 | O |
| 110 | E-2 | 2.45 | 1.15 | 3.60 | ① + ② (equimolar) | 25.7 | II-2 | 0.10 | 20 | 80 | 40 | 0.05 | 3 | 3 | 15.0 | O |
| 111 | E-2 | 1.65 | 1.10 | 2.75 | ① + ② | 16.0 | — | — | 20 | 125 | 105 | 0.06 | 3 | 4 | 15.0 | O |

TABLE 2-continued

| Sample No. | Emulsion No. | Gelatin content($g/m^2$ perside) emulsion layer | protective layer | total | Hardening agent type | amount (mg/g of getatin) | Development restrainer type | amount (g/l of developer) | Melting time (min) | Sensitivity by 90-sec processing | 45-sec processing sensitivity | fog | Granularity | Drying property | Water content on both sides ($g/m^2$) | Remarks |
|---|---|---|---|---|---|---|---|---|---|---|---|---|---|---|---|---|
| 112 | E-2 | 1.65 | 1.10 | 2.75 | (equimolar) ① + ② | 16.0 | I-8 | 0.20 | 20 | 110 | 85 | 0.05 | 3 | 4 | 15.0 | ○ |
| 113 | E-2 | 1.65 | 1.10 | 2.75 | (equimolar) ① + ② | 16.0 | II-2 | 0.10 | 20 | 110 | 80 | 0.05 | 3 | 4 | 15.0 | ○ |
| 114 | E-2 | 0.90 | 1.00 | 1.90 | (equimolar) ① + ② | 11.1 | — | — | 20 | 135 | 105 | 0.09 | 2 | 5 | 15.0 | ○ |
| 115 | E-2 | 0.90 | 1.00 | 1.90 | (equimolar) ① + ② | 11.1 | I-8 | 0.20 | 20 | 123 | 92 | 0.07 | 2 | 5 | 15.0 | ○ |
| 116 | E-2 | 0.90 | 1.00 | 1.90 | (equimolar) ① + ② | 11.1 | II-2 | 0.10 | 20 | 120 | 90 | 0.07 | 2 | 5 | 15.0 | ○ |

As is clear from Table 2, the samples prepared in accordance with the present invention had superior overall ratings in terms of sensitivity, fog, granularity and drying properties and, hence, were adaptive to very rapid processing. In comparison with sample No. 87 or 88 that was processed by the conventional system (90-sec processing), the samples of the present invention achieved high sensitivity even when they were processed for only 45 seconds. This means that the processing method of the present invention is twise as efficient as the conventional system.

As will be apparent from the foregoing description, the present invention enables silver halide photographic materials to be processed at high speed, for instance, at a speed rapid enough to reduce the total processing time to be within the range of 20 to 60 seconds, and yet all of the problems encountered in the prior art system are solved. In short, the photographic materials processed in accordance with the present invention attain high sensitivity, low fog and good granularity. In addition, the gelatin content can be reduced without causing substantial increase in blackening due to abrasion or desensitization under pressure.

What is claimed is:

1. A silver halide photographic material, comprising at least one hydrophilic colloidal layer on a support, and at least one light-sensitive silver halide emulsion layer containing core/shell or tubular type silver halide grains, the silver halide photographic material is exposed and then developed and washed with a roller type automatic processor, the photographic material has a water content of 10–20 g/m2 when the washing step is completed.

2. The silver halide photographic material according to claim 1, having a melting time, which is measured at 50? C., within the range of 8–45 minutes and a gelatin content of 2.00–3.50 g/m2 on the side of said photographic material which contains a hydrophilic colloidal layer with the light-sensitive silver halide emulsion layer.

3. The silver halide photographic material according to claim 1, wherein the photographic material is developed with a developing solution containing a compound of the following formula (IA) and/or a compound of the following formula (IIA):

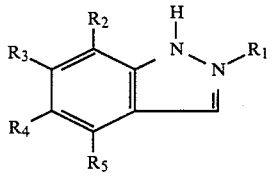

(IA)

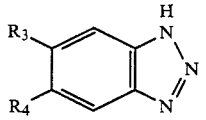

(IIA)

where R1, R2, R3, R4 amd R5 each denotes a hydrogen atom, a lower alkyl group, an alkoxy group, a carboxy group, an alkoxycarbonyl group, a sulfo group, a halogen atom, an amino group or a nitro group, each of these groups optionally having one or more substituents.

4. The silver halide photographic material according to claim 1, wherein said silver halide photographic material is processed in the automatic processor having a total processing time of 20–60 seconds.

5. The silver halide photographic material according to claim 1, wherein the hydrophilic colloidal layer is provided on each side of the support.

6. The silver halide photographic material according to claim 1, wherein the light-sensitive silver halide emulsion layer contains silver iodobromide.

7. The silver halide photographic material according to claim 1, wherein the light-sensitive silver halide emulsion layer contains silver iodide in an amount of at least 10 mole %.

8. The silver halide photographic material of claim 1, wherein the silver halide grains are monodisposed.

9. The silver halide photographic material of claim 1, wherein the light-sensitive material is an X-ray light-sensitive material.

10. The silver halide photographic material of claim 8, wherein the X-ray light-sensitive material has a spectral sensitivity up to 450 nm.

11. The silver halide photographic material of claim 8, wherein the X-ray light-sensitive material has a spectral sensitivity of 540–550nm.

12. A method of processing a silver halide photographic material having at least one hydrophiic colloidal layer on a support and at least one light-sensitive silver halide emulsion layer comprising silver halide grains comprising, exposing the silver halide photographic material and then developing and washing the exposed silver halide photographic material with a roller type automatic processor, the water content of said photographic material being from about 10 to 20 g/m2 when the washing step is completed.

13. The method according to claim 12, wherein the developing step further comprises developing with a developing solution containing a compound of the following general formula (IA) and/or a compound of the following general formula (IIA):

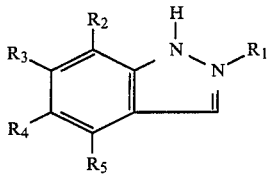

(IA)

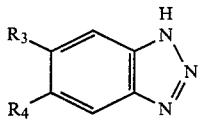

(IIA)

where R1, R2, R3, R4 and R5 each denotes a hydrogen atom, a lower alkyl group, an alkoxy group, a carboxy group, an alkoxycarbonyl group, a sulfo group, a halogen atom, an amino group or a nitro group, each of these groups optionally having one or more substituents.

14. The method according to claim 12 wherein said silver halide photographic material is processed in an automatic processor having a tota processing time of 20–60 seconds.

15. The method according to claim 12 wherein the silver halide emulsion layer contains core/shell or tabular type silver halide grains. The light-sensitive silver halide emulsion layer contains silver iodide in an amount of at least 10 mole %.

* * * * *

UNITED STATES PATENT AND TRADEMARK OFFICE

CERTIFICATE OF CORRECTION

PATENT NO. : 4,897,340

DATED : January 30, 1990

INVENTOR(S) : Shinichi Ohtani et al

It is certified that error appears in the above-identified patent and that said Letters Patent is hereby corrected as shown below:

Claim 1, Column 71, Line 32, "$m^2$" should be -- $m^2$ --;

Claim 2, Column 71, Line 36, "50?" should be --50°--;

Claim 2, Column 71, Line 37, "$m^2$" should be -- $m^2$--;

Claim 12, Column 72, Line 27, "comprising" should be --containing--;

Claim 12, Column 72, Line 32, "$m^2$" should be -- $m^2$ --;

Claim 14, Column 72, Line 61, "tota" should be --total--;

UNITED STATES PATENT AND TRADEMARK OFFICE

CERTIFICATE OF CORRECTION

PATENT NO. : 4,897,340

DATED : January 30, 1990

INVENTOR(S) : Shinichi Ohtani, et al.

It is certified that error appears in the above-identified patent and that said Letters Patent is hereby corrected as shown below:

Claim 15, Column 72, Lines 65-67, delete "The light-sensitive silver halide emulsion layer contains silver iodide in an amount of at least 10 mole %."

Signed and Sealed this

Ninth Day of February, 1993

*Attest:*

STEPHEN G. KUNIN

*Attesting Officer*

*Acting Commissioner of Patents and Trademarks*